US005114306A

United States Patent [19]

Sjogren et al.

[11] Patent Number: 5,114,306

[45] Date of Patent: May 19, 1992

[54] DUAL DRIVE STACKER AND METHOD FOR OPERATING SAME

[75] Inventors: Christer A. Sjogren, Miami; Louis D. Kipp, Miramar; William K. Moritz, Hollywood, all of Fla.

[73] Assignee: Quipp, Incorporated, Miami, Fla.

[21] Appl. No.: 409,625

[22] Filed: Sep. 19, 1989

[51] Int. Cl.[5] ..... B65G 57/11

[52] U.S. Cl. ..... 414/790.4; 414/794.4; 414/900; 271/279; 271/215; 271/217

[58] Field of Search ..... 271/213, 214, 215, 217, 271/218, 279, 202; 414/790.4, 794.4, 900, 790.3; 198/712

[56] References Cited

U.S. PATENT DOCUMENTS

| | | | |
|---|---|---|---|
| 4,162,733 | 7/1979 | Wiseman | 414/794.4 X |
| 4,397,229 | 8/1983 | Merwarth et al. | 414/790.4 X |
| 4,678,387 | 7/1987 | Sjogren et al. | 414/790.4 |
| 5,006,041 | 4/1991 | Sjogren | 414/790.4 |
| 5,024,569 | 6/1991 | Watts et al. | 414/790.3 |

*Primary Examiner*—Robert P. Olszewski
*Assistant Examiner*—Boris Milef
*Attorney, Agent, or Firm*—Louis Weinstein

[57] ABSTRACT

A dual drive signature stacker having side-by-side stacker sections, each of substantially identical design and including a stepper motor for driving a pair of buckets for receiving signatures secured at spaced intervals along a drive chain driven by the stepper motor. the buckets have intercept blades supported by brackets joined to the drive chain to position one of the intercept blades of each drive assembly in front of the adjacent drive assembly so that all of the buckets of the dual drive assembly are in alignment with one another and with the signature stream. The side-by-side arrangement greatly simplifies the design cost and assembly. A microprocessor-based control system permits stacking of stacks having as few as two signatures and is further capable of forming successive signature stacks of differing count in a precision manner and compatible with the speeds of any signature flow rate.

21 Claims, 15 Drawing Sheets

10

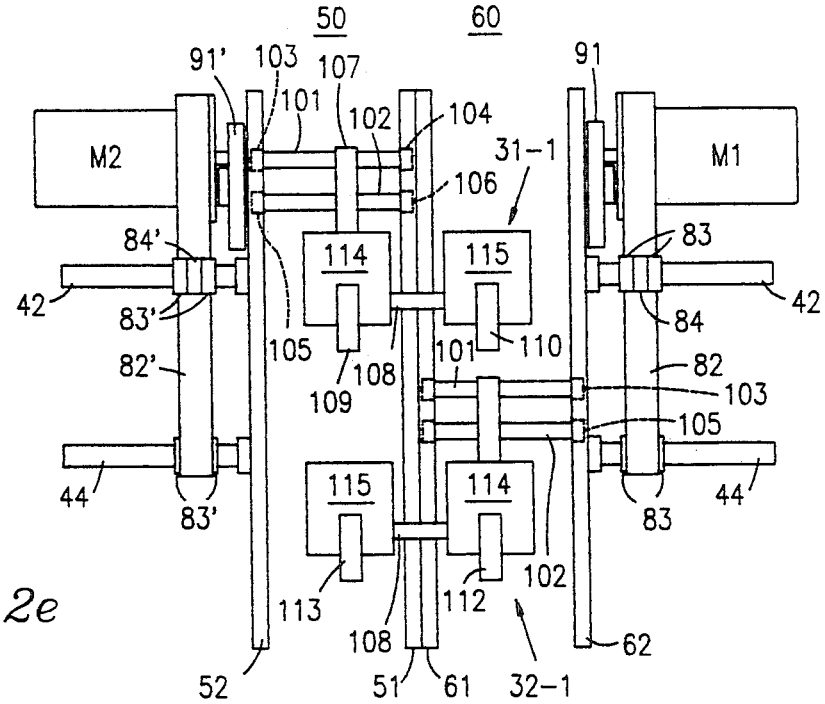
Fig. 2e
Fig. 2b
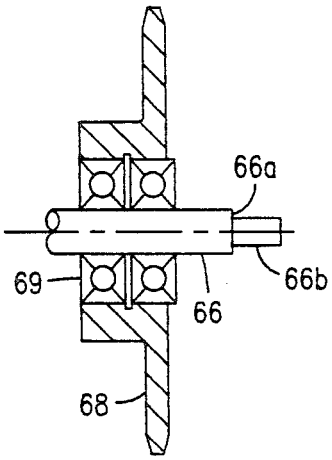
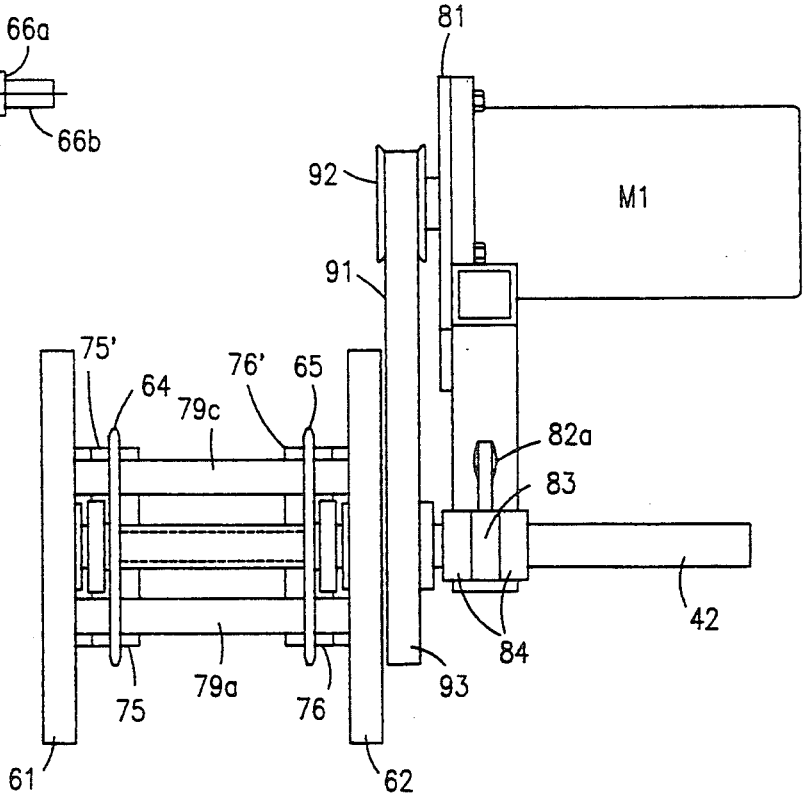
Fig. 2c

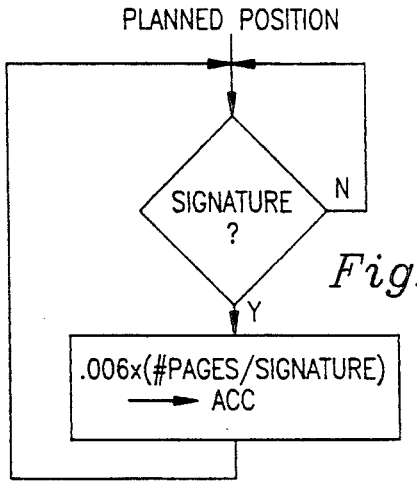
Fig. 7c
Fig. 7b
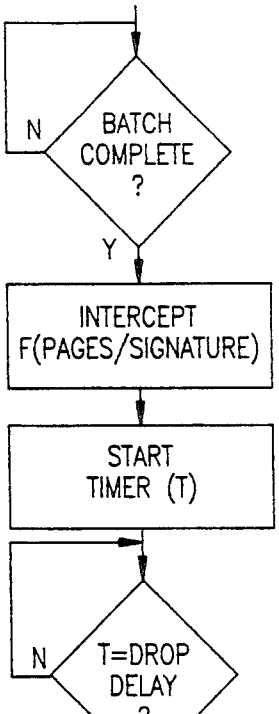
Fig. 8
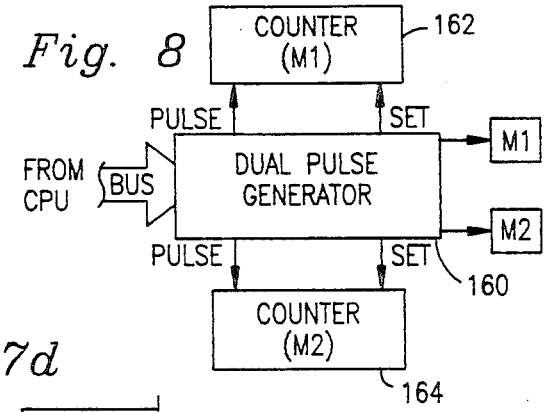
Fig. 7d
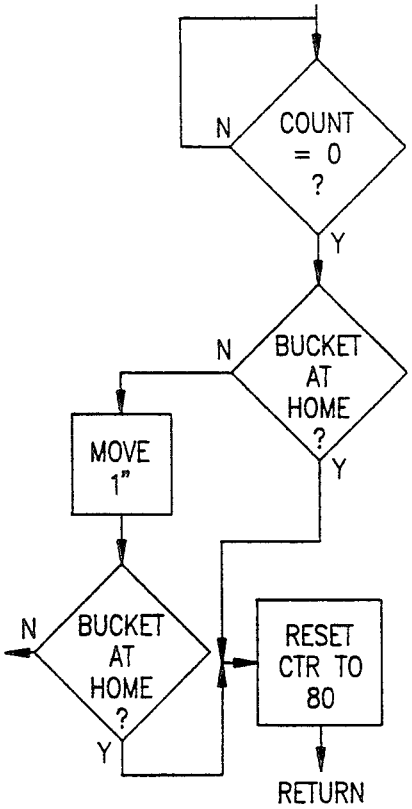

DUAL DRIVE STACKER AND METHOD FOR OPERATING SAME

FIELD OF THE INVENTION

The present invention relates to stackers and more particularly to a dual drive stacker of novel side-by-side design and including novel microprocessor-based control means for controlling the operation of the dual drive stacker.

BACKGROUND OF THE INVENTION

Newspaper stackers are well known for creating signature (i.e. newspaper) bundles of precise count for subsequent tying and delivery. Conventional stackers accept signatures arranged in a "shingle" or imbricated fashion delivered from a newspaper press typically at rates as high as eighty thousand per hour or greater. The stacker is provided with intercept means for intercepting the signature stream and collecting signatures upon a stacking platform or "bucket", the signatures being accumulated thereon until the desired count is reached at which time an upstream bucket is caused to intercept the signature stream and begin collection of the next stack.

To meet present requirements, stackers must be capable of stacking any desired count of signatures and further be capable of forming stacks of signatures of differing amounts wherein each successive stack may be a count different from the proceeding downstream stack.

Extreme applications exist wherein the difference between the count of a substantially completed stack and the next stack to be formed is quite significant and further wherein it is desired to be capable of forming stacks of extremely small count. In conventional stackers, there is provided a single motor for driving a pair of drive chains. Chain driven buckets arranged at spaced intervals along the chains pass the downstream end of an infeed conveyor section as the chain drive is operated to cause the newspaper stream to be intercepted. Counting means is typically provided in the stacker infeed conveyor section for counting the signatures. When a predetermined count is reached, the bucket immediately behind the bucket receiving newspapers is moved to the intercept position causing subsequent newspapers to be collected on the bucket which was just moved to the intercept position. Since all of the buckets are mechanically linked to the drive chains, all of the buckets are driven at the same operating speed imposing severe limitations upon bundle size for the reason that once a bucket is moved to the intercept position, the bucket is driven through the stacking region at normal stacking speed. Thus, the bucket immediately behind the bucket which has been moved to the intercept position likewise moves to the latched or "home" position at normal stacking speed. If the bucket in the stacking region receives the predetermined number of newspapers before the next bucket coupled to the drive chain reaches the latched position, then the next bucket in line will not be provided with the necessary amount of acceleration required to cleanly intercept the newspaper stream and thereby assure an accurate count. In addition, when the stacker receives signatures at very high press speeds, the feed rate of signatures being stacked may be so great as to create a stack of signatures larger than the desired number before the next bucket may be moved to the intercept position, likewise causing an error in signature count. Due to these factors, conventional stackers have the disadvantages of being limited as to the smallest bundle which can be formed by the stacker and also have an upper limit as to the number of newspapers per unit time which can be fed to the stacker for rapidly forming bundles of an exact predetermined count.

In order to overcome these limitations, dual drive stackers have been developed. Such dual drive stackers are described, for example, in U.S. Pat. Nos. 3,479,932 and 3,526,170 in which first and second drive chains are independently driven by either independent motors or a single motor and appropriate coupling and speed control means including clutches and the like. In U.S. Pat. No. 3,479,932 the drive chains are driven at either a normal stacking speed or at a high speed greater than the normal stacking speed. Each set of chains is provided with at least one stacking bucket so that while one bucket is moving through the stacking region at normal stacking speed, the other bucket associated with the other set of chains is moved at high speed to the home or intercept ready position in readiness for receiving and collecting the next signature stack.

U.S. Pat. No. 3,526,170 provides first and second variable speed motors and a complicated mechanical arrangement of cams and cooperating cam switches for altering the motor speed at various locations about the path traversed by each stacking bucket. Also the system requires mechanical blocking cams to prevent collision between buckets driven by different chain drives.

The prior art dual drive stackers as represented by the aforementioned U.S. patents utilize independent chain drives which are arranged on common shafts, requiring a complicated arrangement of mounting bearings rendering it a practical impossibility to properly independently tension each of the drive chains. In addition, the systems require mechanical latching means at the intercept ready position and also lack means for substantially instantaneously regulating the bucket operating speed to accommodate any changes whether they be from stack-to-stack or signature-to-signature during the formation of a stack.

BRIEF DESCRIPTION OF THE INVENTION

The present invention is directed to dual drive stackers and particularly to a stacker design which is characterized by comprising totally independent side-by-side bucket drive systems which are substantially symmetrical to one another and cooperate with one another, under control of a common microprocessor-based controller to yield stacking capabilities not heretofore obtainable through stacking systems of either the single or dual chain drive type.

Each of the individual stacking systems is comprised of a chain drive directly operated by a stepper motor and having independent tensioning means to properly and adequately tension each chain drive and each motor drive. Both motor drives are mounted at the upper end of the stacker on opposite sides of each chain drive system and each are swingably mounted and coupled to the chain drive through a timing belt. The mounting of both stepper motors at the upper end of the stacker eliminates any conflict with the outfeed mechanism, and further eliminates the need for coupling means of different lengths coupling the stepper motors to the sets of chains. Means are provided for independently setting the proper tension for each timing belt. Each chain drive system is provided with its own chain drive mechanism and chain guides.

Each chain drive system further includes buckets arranged at spaced intervals about the drive chain and fixedly secured to the chain drives. In addition, the buckets are provided with cam followers which ride in a cooperating cam for controlling the travel path of the buckets. Each of the buckets include intercept blades and blade mounting structures which position the intercept blades of each chain drive system so that they are aligned to move along a common path, the intercept blade mounting bracket extending sidewise from its associated chain drive system toward the adjacent chain drive system in order to properly align the intercept blades, i.e. the signature collecting portions of the bucket assemblies, thereby providing a common bucket path in spite of the fact that the chain drive systems are arranged in side-by-side fashion.

The buckets are fixedly secured at spaced intervals along their associated drive chains and, by operation of the stepper motor, acceleration of the bucket from the intercept ready to the intercept position is accomplished through microprocessor-based controls.

The dual drive stacker is provided with an infeed section that is adjusted in a dynamic fashion so as to operate at a speed compatible with the upstream conveyor delivering imbricated signatures thereto to provide infeed drive control by comparing the conveyor speed against a minimum speed reference and is operator adjustable to cause the infeed section to follow the conveyor speed for speeds above the minimum speed adjustable over a plus or minus twenty percent (±20%) speed change range by adjusting the pulse generating rate and the sampling rate of the monitoring and control system. The system is designed so that there is a direct relationship of pulses per sample to the digital word converted into a control drive.

The control system is capable of adjusting the intercept operation by accelerating the bucket in the intercept ready ("home") position at a very rapid rate due to the employment of stepper motors. Novel means are utilized for establishing the intercept stroke as a function of product thickness.

The control system further provides simultaneous control over both motors to provide a delay sufficient to permit the last signature to settle on the formed batch.

The system further initiates motion of both chain drive systems upon conclusion of the settling delay, moving the bucket which produces the intercept through the batch forming area while initiating a drop cycle for the bucket of the other chain drive system. The bucket receiving a batch is moved so as to maintain a minimal drop distance between the bucket (or the signatures already stacked thereon) and the next signature being delivered to the bucket to eliminate the need for the signature to experience free fall through a vertical drop thereby significantly enhancing the formation of a neat batch.

The system further controls the bucket which has entered the stacking region to initially move downwardly to a "safe" position to prevent the signatures collected on said bucket from being compressed when the bucket presently in the intercept ready position is abruptly moved to the intercept position.

The bucket is moved to the "safe" position even in the event that there is an interruption on the paper stream and a diverting of the paper stream from the bucket receiving signatures to the bucket just moved to the intercept position. The system also provides downward movement of the bucket from the "safe" position by an amount sufficient to accommodate the space required by the forming batch (to substantially prevent signatures from experiencing a vertical drop) thereby assuring that the bucket moves downward until the batch is fully formed.

A top-of-batch sensor is positioned to monitor the space above the formed batch and, should the signatures become crowded, as sensed by this sensor, the stacking section is moved downward at an increased rate to provide relief and, if the situation becomes serious, a clear cycle is initiated in an effort to continue normal stacker operation.

When the stack is completed, the bucket enters into the drop region. During a drop cycle, the bucket accelerates rapidly to quickly reach the correct speed for dropping the batch upon a turntable or other collection means. Thereafter, the control system decelerates the bucket as it leaves the drop region and moves toward the home position enabling the bucket to be halted at the home position with precision.

Means are provided for modifying the drop characteristic of the bucket by way of an operator entry to drop the formed batch squarely upon the turntable regardless of whether the signature is of broad sheet or tabloid makeup.

The system further provides a clear cycle causing the controller to step through a predetermined sequence which is initiated as soon as a bucket arrives at the home position, completing a stacking section cycle within approximately one second, in readiness for subsequent batching operations.

An initialization routine, which is initiated by a start button, places the buckets of the side-by-side chain drive systems in proper relationship to the infeed and to each other, whereby one of the set of buckets associated with one of the chain drive systems is moved to the home position and one of the buckets of the other chain drive system is moved to a position a predetermined distance from the home position, in readiness to initiate the collection of newspapers.

The system monitors the feed rate using a data queuing and averaging technique to assure the performance of a smooth stacking operation regardless of the presence of a uniform stream or a broken stream of signatures, the technique being utilized being relatively insensitive to breaks or gaps in the stream while at the same time being sufficiently responsive to increases in speed of the signature stream. This technique is utilized to adjust batching speed on an instantaneous basis, i.e. from paper to paper.

A top-of-batch sensor is provided to further assure that there is adequate room provided between adjacent buckets for uniform stacking. The top of batch sensor is monitored and, in the event that a first output is detected indicating that the sensor has been lifted a first predetermined amount, the stacking bucket is instantaneously altered to travel at a speed twenty-five percent faster than that indicated by the rate calculation. If a second (more serious) level of crowding is detected, i.e. if the sensor is lifted a second (larger) predetermined amount, the stacking section speed is increased to a maximum predetermined value. By constantly monitoring this sensor, the increased speed is reduced as soon as the pressure on the sensor (due to crowding) is relieved, i.e. by lowering of the sensor toward a normal level.

The speed at which a bucket moves through the stacking section is either the calculated speed determined by the rate routine or a minimum speed, whichever is greater. This speed is maintained unless the top of batch limit is exceeded or a clear cycle is initiated.

Once a bucket in the stacking region has reached a predetermined "safe" position, it may periodically either stop or continue based on the following criteria:

A bucket will continue to drive if the actual position is less than or equal to the planned position or will stop if the actual position is downstream relative to the planned position. The planned position is determined by counting signatures as they pass a sensor in moving through the infeed section. The actual position is determined by counting the drive pulses applied to the stepper motor to advance the bucket from the home position.

As long as the bucket has not moved beyond the planned position, the bucket will continue to move downward responding to speed changes as indicated by the rate calculation.

The collision of alternate buckets is prevented by monitoring the pulse counts and then comparing them against a home position condition. If the pulse counts fall outside of a predetermined range, the chain drive systems are halted and an initialization routine is initiated.

The pulses for each stepper motor are counted starting with the home position there being a predetermined number of pulses to represent a full cycle. The control system continuously looks for home. When the present count is reduced from said predetermined count to zero and there is no home signal from the home position sensors, the system indicates a failure and halts the stacker. Preferably the system control advances the bucket an additional predetermined distance and thereafter halts operation of both chain drives if the bucket being monitored has yet to reach the home position.

Thus, the system is fully controlled through the microprocessor in a unique and dynamic fashion.

OBJECTS OF THE INVENTION

It is, therefore, one object of the present invention to provide a dual drive stacker having novel independent side-by-side bucket drive assemblies.

Still another object of the present invention is to provide a novel dual drive stacker for counting and stacking signatures and the like comprising independent chain drive assemblies capable of being tensioned independently of one another.

Still another object of the present invention is to provide a novel dual drive stacker in which the drive motors are both mounted at the top of their respective drive assemblies immediately adjacent their associated drive sprockets.

Still another object of the present invention is to provide a novel dual drive stacker having independent bucket drive means arranged in side-by-side fashion and provided with a novel bucket arrangement having bucket supports which extend the bucket interceptor blade assembly driven by each of said bucket drives in front of the adjacent bucket drive system.

Still another object of the present invention is to provide a novel dual drive stacker having side-by-side bucket drive assemblies in which the buckets of both drive assemblies are mounted in an offset fashion relative to their drive assemblies to align the buckets of both drive systems to move along a common path.

Still another object of the present invention is to provide a stacker for counting and stacking signatures and the like employing stepper motor means which are controlled to provide all of the proper bucket functions eliminating the need for conventional latches and auxiliary acceleration means.

Still another object of the present invention is to provide a novel stacker for counting and stacking signatures and the like and comprising swingably mounted coupling means for coupling each bucket to its drive chains to accommodate for any differences in the pitch lines of the drive chains and the path followed by the bucket cam followers.

Still another object of the present invention is to provide a novel stacker for forming signature stacks of a precise count comprising cam means for guiding cam followers provided on each bucket to precisely control the movement of each bucket about a predetermined bucket path and utilizing said cam means, together with motor drive means for facilitating acceleration in the performance of the intercept and drop-out operations.

Still another object of the present invention is to provide a novel dual drive stacker for counting and stacking signatures and the like and having side-by-side bucket drive means mounted upon common support rods.

Still another object of the present invention is to provide a dual drive stacker having novel electronic control means for controlling all of the bucket operations.

Another object of the present invention is to provide novel control means for monitoring conveyor speed to maintain the stacker infeed section at a speed compatible with the conveyor speed.

Still another object of the present invention is to provide novel control means for stackers and the like comprising microprocessor-based control means for dynamically controlling bucket operating speed.

Still another object of the present invention is to provide novel electronic means for dynamically controlling the bucket operating speed in accordance with a plurality of operating conditions being constantly monitored.

Still another object of the present invention is to provide novel electronic solid-state control means for controlling the buckets of a dual drive stacker to maintain operation within predetermined limits to prevent collision.

Still another object of the present invention is to provide novel electronic solid-state control means for stackers and the like in which bucket operating speed is dynamically changed according to predetermined operating conditions and further including sensor means for overriding the present operating speeds determined by the control system when the sensor stacks detects the presence of certain stacking conditions.

BRIEF DESCRIPTION OF THE FIGURES

The above, as well as other objects of the present invention will become apparent when reading the accompanying description and drawing, in which:

FIG. 2*b* shows a schematic view similar to that shown in FIG. 2*a* in which a number of the details of the drive mechanism have been omitted and showing the bucket arrangement in greater detail.

FIG. 2*c* shows a top plan view of the right-hand drive assembly of FIG. 2*a*.

FIG. 2*e* shows a sectional view of one of the idler sprockets of FIG. 2*a*.

FIGS. 7*a* through 7*e* are flow diagrams useful for describing certain operations of the stacker of FIG. 1.

FIG. 8 is a block diagram of the stepper motor controls.

DETAILED DESCRIPTION OF THE INVENTION

Figure 1:
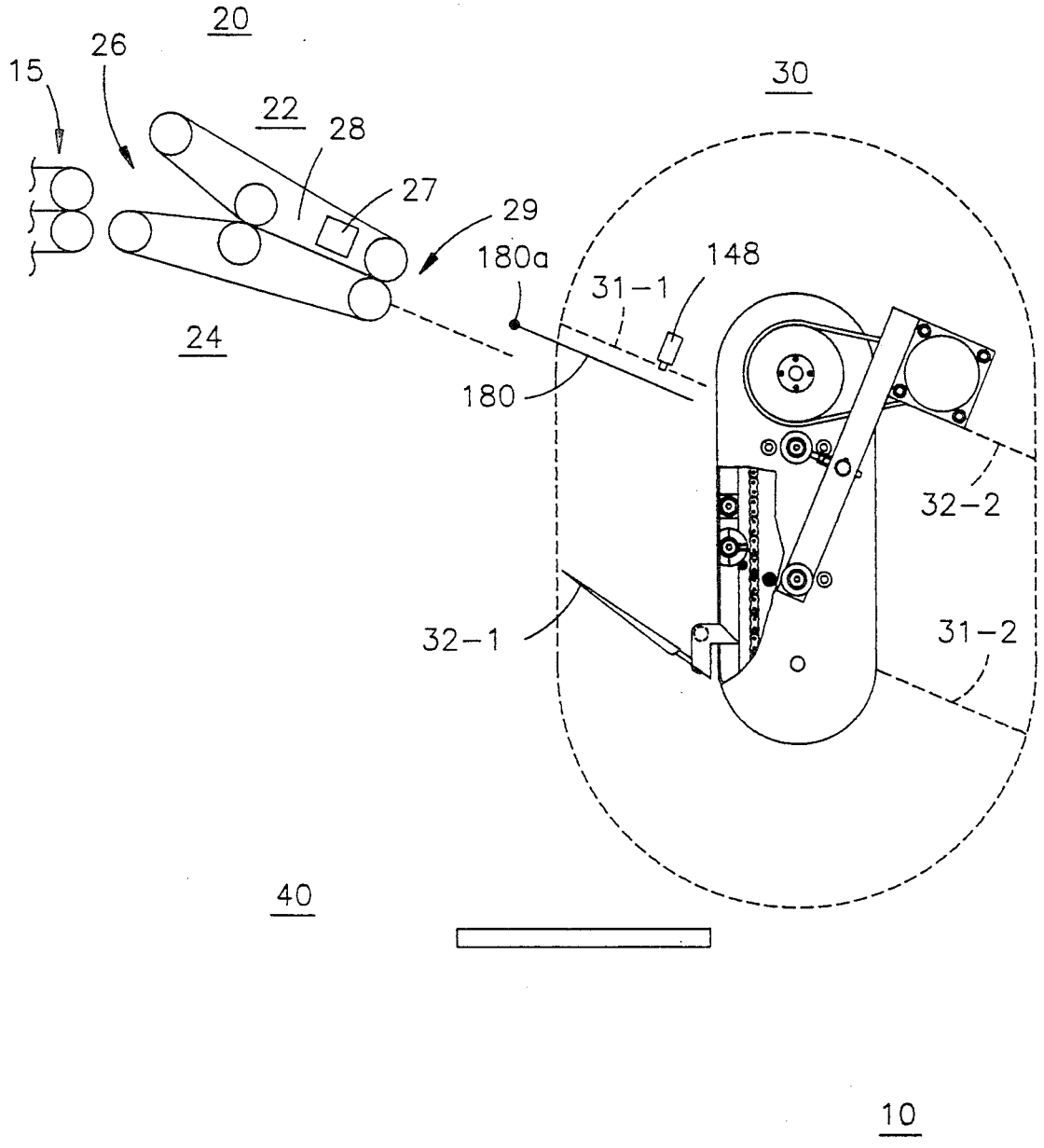
FIG. 1 shows a schematic view of a stacker embodying the principles of the present invention.

FIG. 1 shows a schematic view of a stacker 10 designed in accordance with the principles of the present invention and comprising an infeed section 20, a stacking section 30 and a stack collecting section 40.

The infeed section 20 cooperates with a press conveyor section 15 for delivering imbricated signatures to infeed section 20. The signature stream delivered by the press conveyor 15 is arranged folded edge forward with the signatures arranged in the conventional "shingle" (imbricated) manner with the folded edges of adjacent signatures preferably spaced in the range from two to six inches apart measured in the delivery direction or, for example, in the horizontal direction based on the orientation of the press conveyor 15 shown in FIG. 1.

Signatures enter infeed section 20 comprised of upper conveyor assembly 22 and lower conveyor assembly 24 each provided with a plurality of conveyor belts and rollers arranged to define an initial infeed portion 26 with a substantially V-shaped input end (as is conventional) for guiding the signature stream into the region 28 in which the signature stream is pressed together by the urging of the upper and lower conveyor sections 22 and 24 to remove any air trapped between adjacent signatures and between the pages of each signature so as to simplify handling of the signatures. As is conventional, the infeed conveyor section typically imparts a slight V-shape to the signatures as they leave the infeed section outlet end 29 for delivery to one of the buckets (to be more fully described) within the stacking section 30 to stiffen the signatures to enhance their stacking. A sensor 27 is utilized to count the signatures as they pass the sensor, the count pulse being utilized for controlling the bucket intercept and operating speeds as will become apparent from a further detailed description thereof. Top-of-batch sensor 148 is movable upward by a pivotally mounted plate 180 when signatures become crowded above the normal top-of-batch position due to signatures being fed more rapidly than the downward movement of the stacking bucket presently receiving signatures. Said bucket is moved at a rate sufficient to cause signatures leaving the infeed section to move through only a minimal drop distance as they fall onto the bucket, to assure the formation of neet batches.

The stacking section 30 includes first and second pairs of independently driven stacking platforms or "buckets". More specifically, buckets 31-1 and 31-2 are driven by a common drive system while buckets 32-1 and 32-2 are driven by a second drive system independent from the first-mentioned drive system, as will be more fully described. Bucket 32-1, for example, occupies the position of a bucket which has substantially completed stacking a predetermined quantity of signatures thus completing its movement through the stacking region, and is about to enter into the drop region where it will be accelerated in a manner to assure that the stack of signatures supported thereon is oriented in a horizontal manner when it is caused to drop and move by free fall from the bucket 32-1 to an outfeed section 40 which is typically comprised of a turntable for receiving and supporting a stack of signatures and which is typically capable of rotating through 180 degrees before receiving the next stack of signatures to form a so-called "compensated" bundle as is conventional. For example, note U.S. Pat. No. 4,749,077, issued Jun. 7, 1988, and assigned to the assignee of the present invention disclosing such a turntable. Alternatively, the outfeed section 40 may comprise any other type of stack receiving apparatus such as, for example, a simple outfeed conveyor for conveying a completed stack typically either to the left or to the right and out of the stacker proper. Any other type of outfeed section or turntable of either the uncompensated or compensated bundle forming type may be employed with the novel stacking section of the present invention.

The nature of the present day applications require the provision of stackers having extreme versatility to accommodate a wide variety of stacking situations, such as being capable of forming stacks of signatures whose quantity varies from an extremely small number to a rather large number and further in which successive stacks of different counts may be formed and, in fact, wherein such successive stacks may have counts at the high and low range of capability of the stacker.

These objectives are not capable of being obtained through conventional stackers and necessitate the use of dual drive stackers as are described in the aforementioned U.S. Pat. Nos. 3,479,932 and 3,526,170. However, as pointed out hereinabove, these present day stackers are incapable of forming stacks of an extremely small count and are complicated and are incapable of dynamic control and further are difficult to tension due to the mounting of the drive and idler sprockets of the independent chain drives upon common shafts.

The present invention resolves all of the above disadvantages as well as others as will become apparent from the ensuing description in which FIGS. 2*a*–2*g* show stacker section 30 as being comprised of left and right-hand drive systems 50 and 60 for independently driving the buckets 31-1 and 31-2, and 32-1 and 32-2 respectively. Since the independent drive assemblies are substantially identical in design and operation, only one of said systems will be described herein for purposes of simplicity, like elements, for the most part, having been designated by like unit digits to further facilitate the relationship between the assemblies 50 and 60.

Right-hand drive assembly 60 is comprised of a pair of frames 61 and 62, each provided with upper openings suitable for rotatably mounting shaft 63 supporting chain drive sprockets 64, 65. FIG. 2*h* shows a view of frame 62 looking in the direction of arrows D—D of FIG. 2*a*. Upper opening 62*a* rotatably supports shaft 63. Openings 62*b* and 62*c* receive and support common rods 42 and 44 which are utilized to rigidly secure independent drive assemblies 50 and 60 to one another and further provide the means for supporting the stacking section 30 upon the stacker main frame (not shown for purposes of simplicity).

The elongated slot 62*d* supports the shaft 66 for mounting idler sprockets 67, 68. FIG. 2*e* shows idler shaft 66 supporting idler sprocket 68 by means of bearing assembly 69. Collars 69*a*, 69*b* maintain the sprockets 67 and 68 and spacer 69*c* in their proper position.

The idler sprocket shaft (see FIG. 2*e*) is provided with flats 66*a*, 66*b* to fit into elongated slot 62*d* (FIG. 2*h*) and to permit slidable movement therealong while at the same time preventing shaft 66 from rotational movement. It should be understood that frame 61 has a similar elongated slot and that the opposite end of shaft 66 is likewise provided with a pair of flats to facilitate slidable engagement within the elongated slot of frame 61.

A tensioning assembly 70 comprises a threaded shaft 71 having its lower end secured to spacer 69*c* and having its upper end extending through an opening in shaft 44. Threaded nuts 72 threadedly engaging threaded shaft 71 to adjust the spacing between shaft 44 and the disc 73 to thereby control the tension imposed upon the drive chains entrained about cooperating drive and driven sprockets 64–67 and 65–68. A pair of rubber bushings 74 are designed to yield in order to prevent the chains from being damaged or broken, thereby providing the chains with dynamically adjusted tensioning.

Figure 2A:
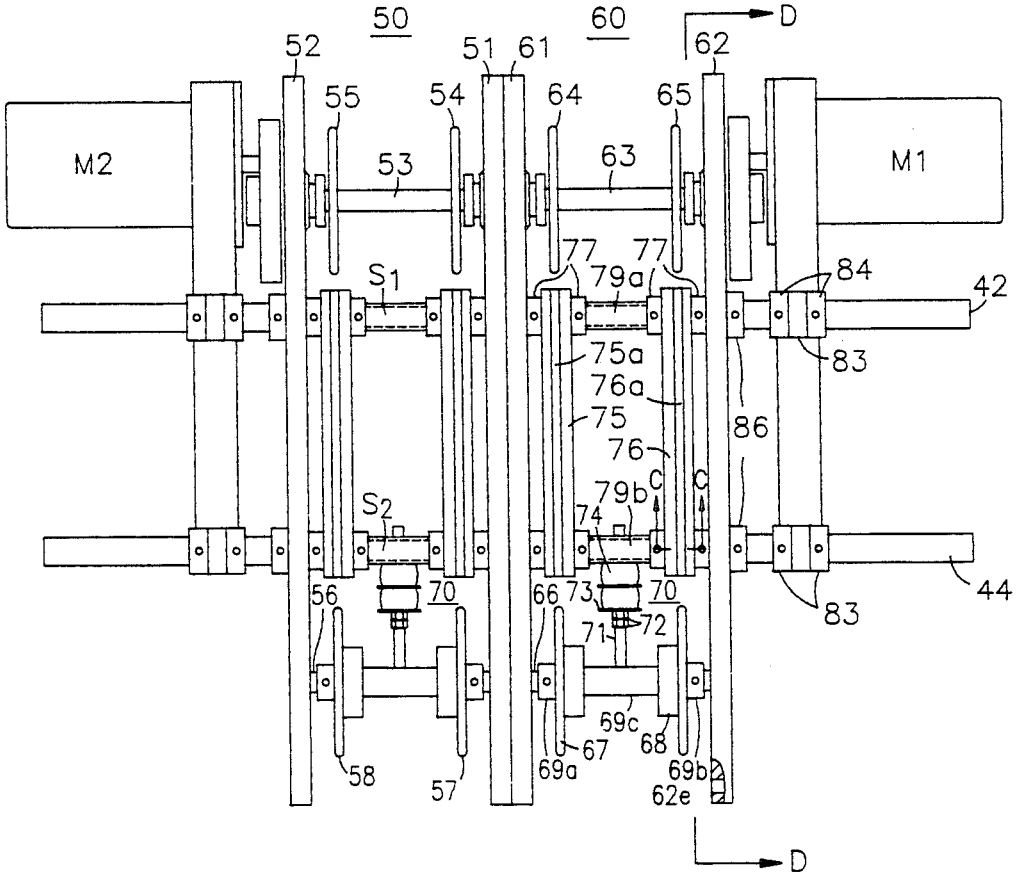
FIG. 2*a* shows a front elevational view of the stacker of FIG. 1 showing the side-by-side independent chain drive systems of the present invention in greater detail.
Figure 3B:
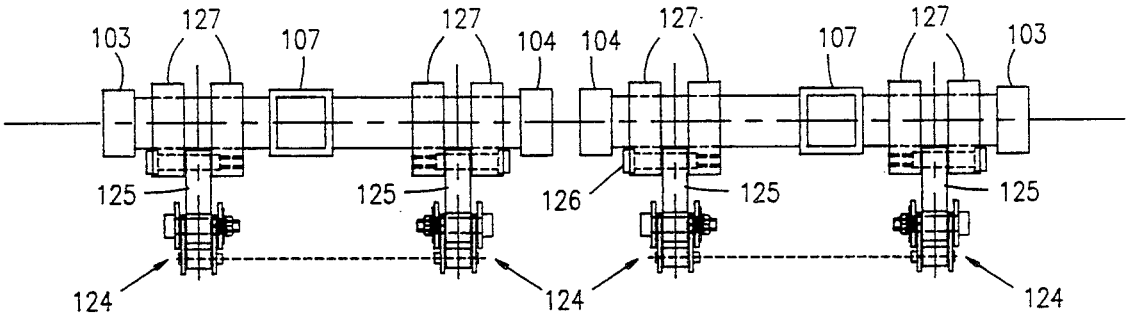
FIG. 3*b* shows a top view of the coupling mechanism for coupling a bucket to its associated drive chains.
Figure 2G:
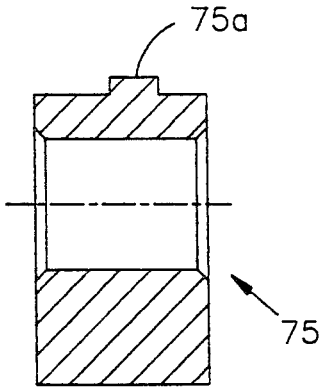
FIG. 2*g* shows a view of a chain guide bracket of FIG. 2*a* looking in the direction of arrows C—C.

Frame 62 is provided with an oval-shaped cam 62*e*, note also FIG. 2*a*, comprised of two straight parallel portions and upper and lower substantially semi-circular portions, for receiving and guiding the cam follower rollers of each bucket in order to accurately control the path of movement and orientation of each bucket throughout its operating cycle, as will be more fully described.

Front and rear pairs of elongated chain guides, including guides 75, 76 (see FIGS. 2*a*, 2*d* and 2*h*) are provided with upper and lower openings to respectively receive upper and lower mounting shafts S1 and S2 so as to be aligned and supported behind the straight runs of the drive chains. Collars 77 maintain the horizontal alignment of the guides 75 and 76 along the shafts S1 and S2. Each guide is provided with a elongated rail 75*a*, 76*a* which extends into the region between a pair of chain links, whereby the chain links are arranged to slide along the side edges of the associated rail to maintain the vertical alignment of the chain links and further to assure stable, planar movement of the drive chain through the stacking region and through the return region.

Figure 2D:
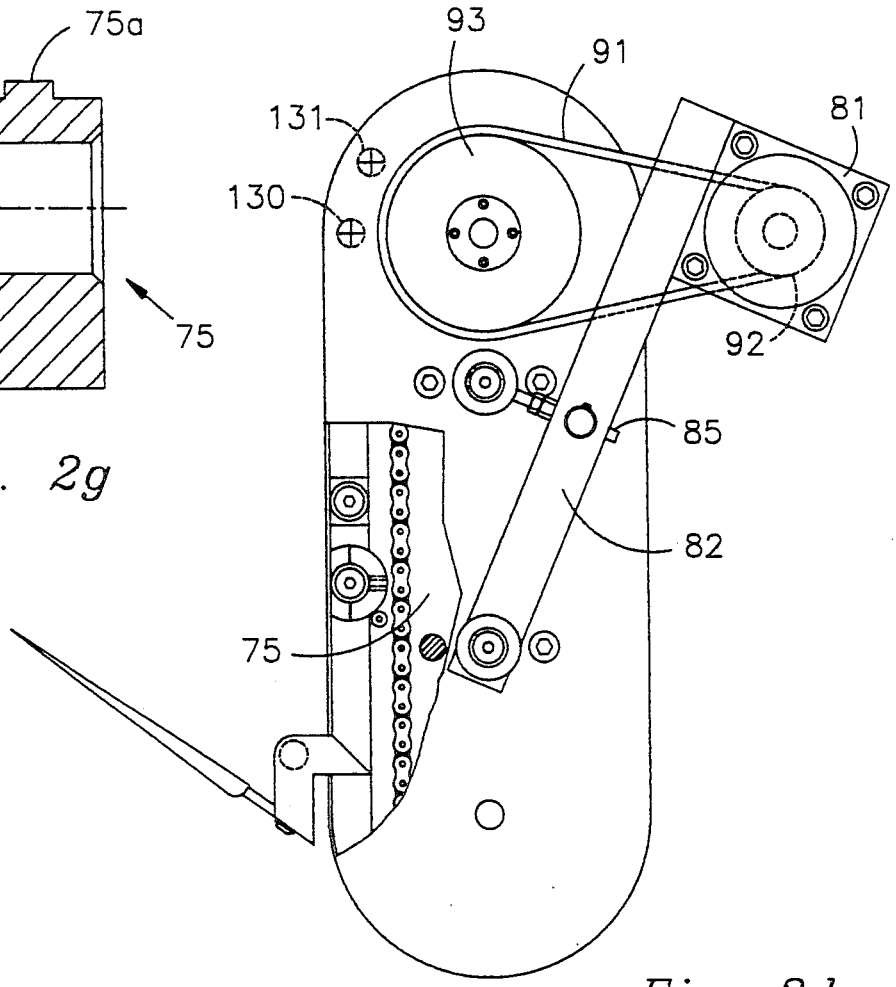
FIG. 2*d* shows a side elevational view, partially sectionalized, of the stacking section assembly of FIG. 2*a*.
Figure 2F:
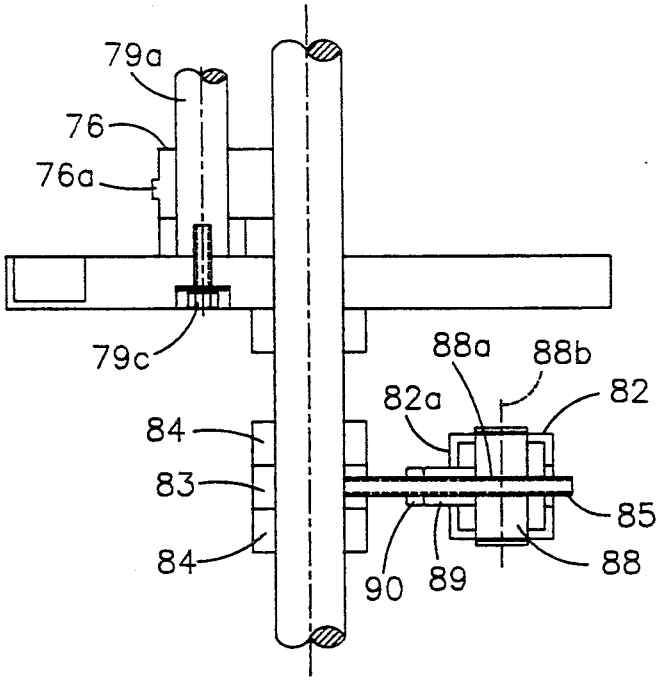
FIG. 2*f* shows a sectional view of the tension adjusting mechanism for the stepper motor timing belt looking in the direction of arrows B—B of FIG. 2*d*.
Figure 2H:
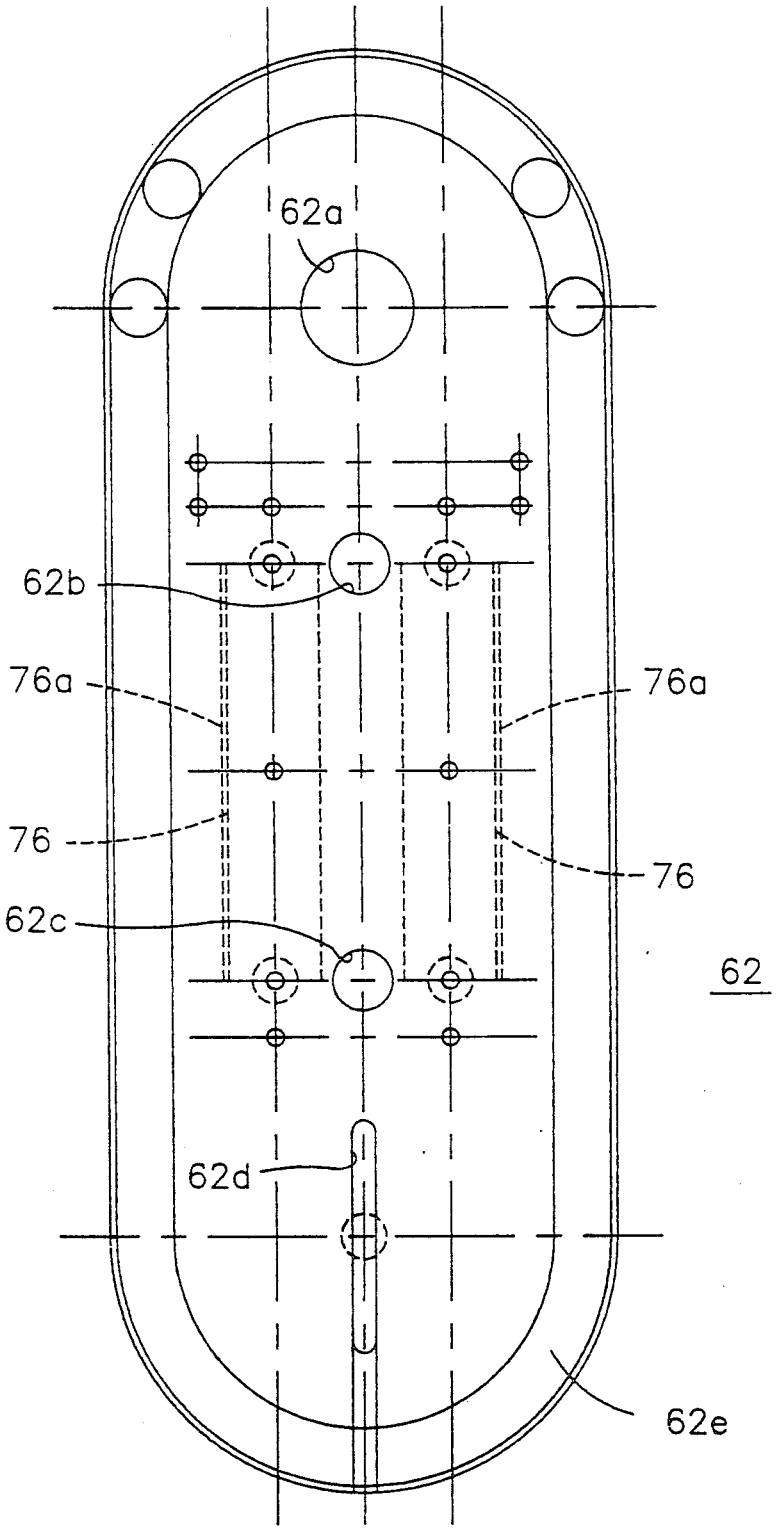
FIG. 2*h* is a plan view of one of the side plates shown in FIG. 2*a*.

The right-hand bucket drive assembly 60 is driven by motor Ml which is mounted upon a support plate 81 secured at the upper free end of swingable arm 82 which is pivotally mounted upon shaft 44. Collars 83 fix the horizontal position of swingable arm 82 along shaft 44. A tensioning device, shown best in FIGS. 2*d* and 2*f*, is comprised of a collar 83 encircling and revolvable about shaft 42 and having its horizontal position along shaft 42 retained by collars 84. Note also FIG. 2*a*.

A threaded shaft 85 has its left-hand end secured to collar 83, extending through openings in arm 82, which can be seen from FIG. 2*f* to be a hollow tubular member of substantially square cross-section. Shaft 85 also extends through a stub shaft 88 arranged within swingable arm 82, provided with a central opening 88*a*. A hollow cylinder 89 integrally joined to shaft 88 extends through an elongated opening 82*a*, which is elongated in the longitudinal direction, to permit shaft 88 and hollow cylindrical member 89 to experience rotational movement about axis 88*b* upon adjustment of the tensioning mechanism which is comprised of a threaded nut 90 which threadedly engages threaded shaft 85 to adjust the spacing between shaft 42 and swingable arm 82 in order to control the tension imposed upon timing belt 91 entrained about a drive timing belt pulley 92 and a driven timing belt pulley 93 (note also FIG. 2*c*).

Figure 3A:
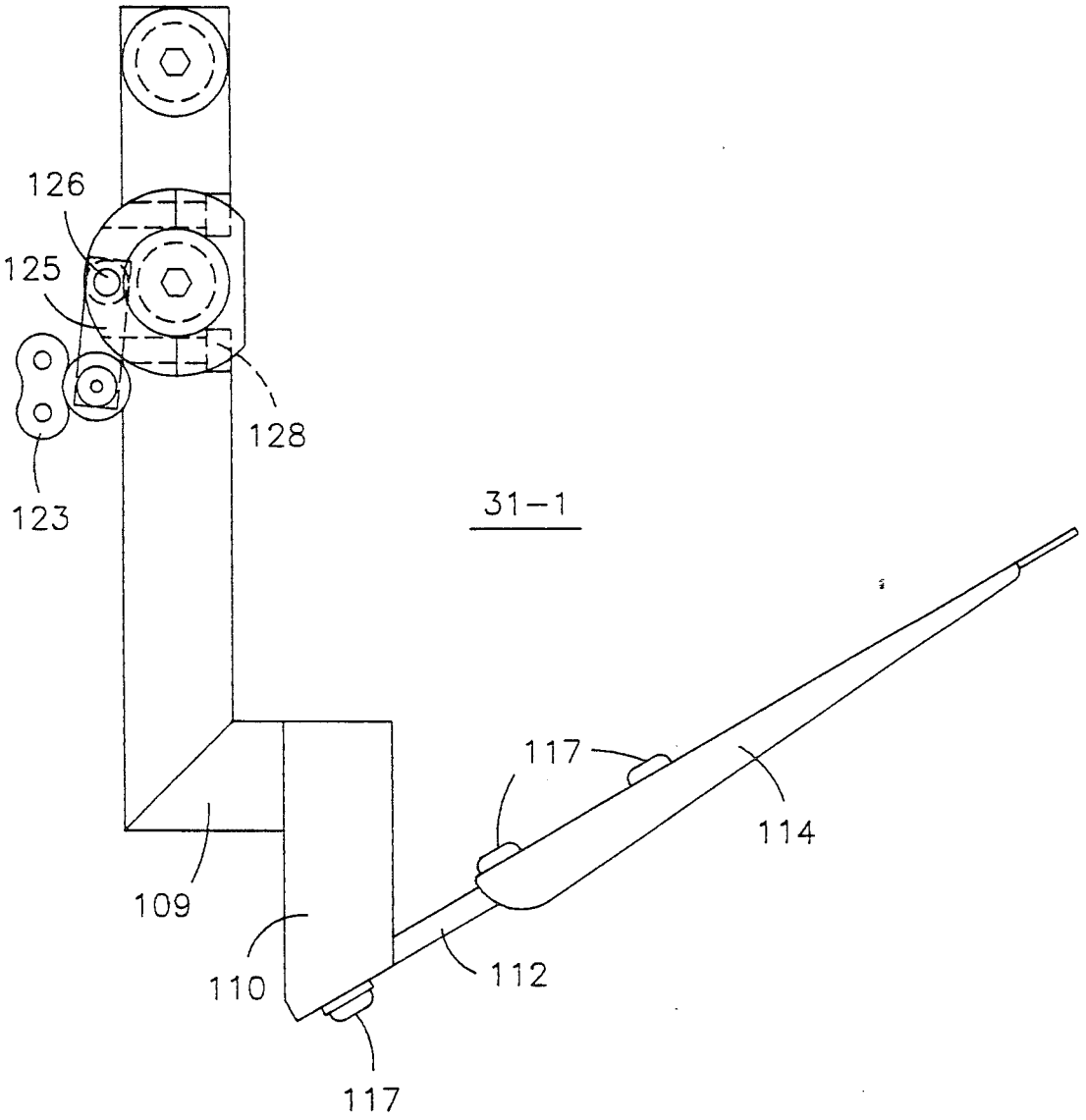
FIG. 3*a* shows an end view of one of the buckets of the stacker shown in FIG. 2*b*.
Figure 3D:
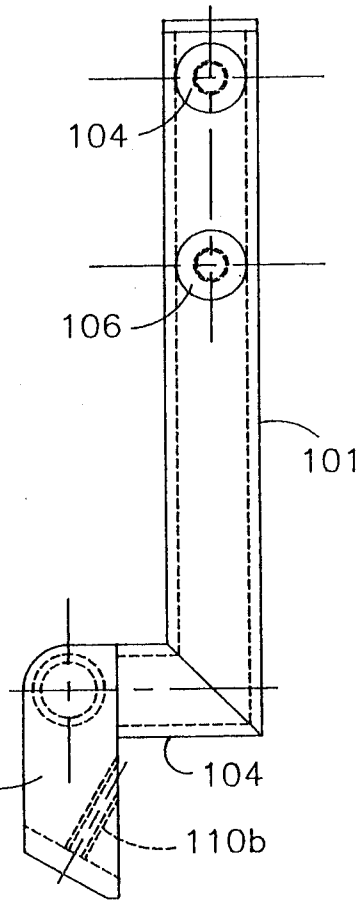
FIG. 3*d* shows a view of an interceptor blade subassembly mounted to the bucket support of FIG. 3*c*.
Figure 3C:
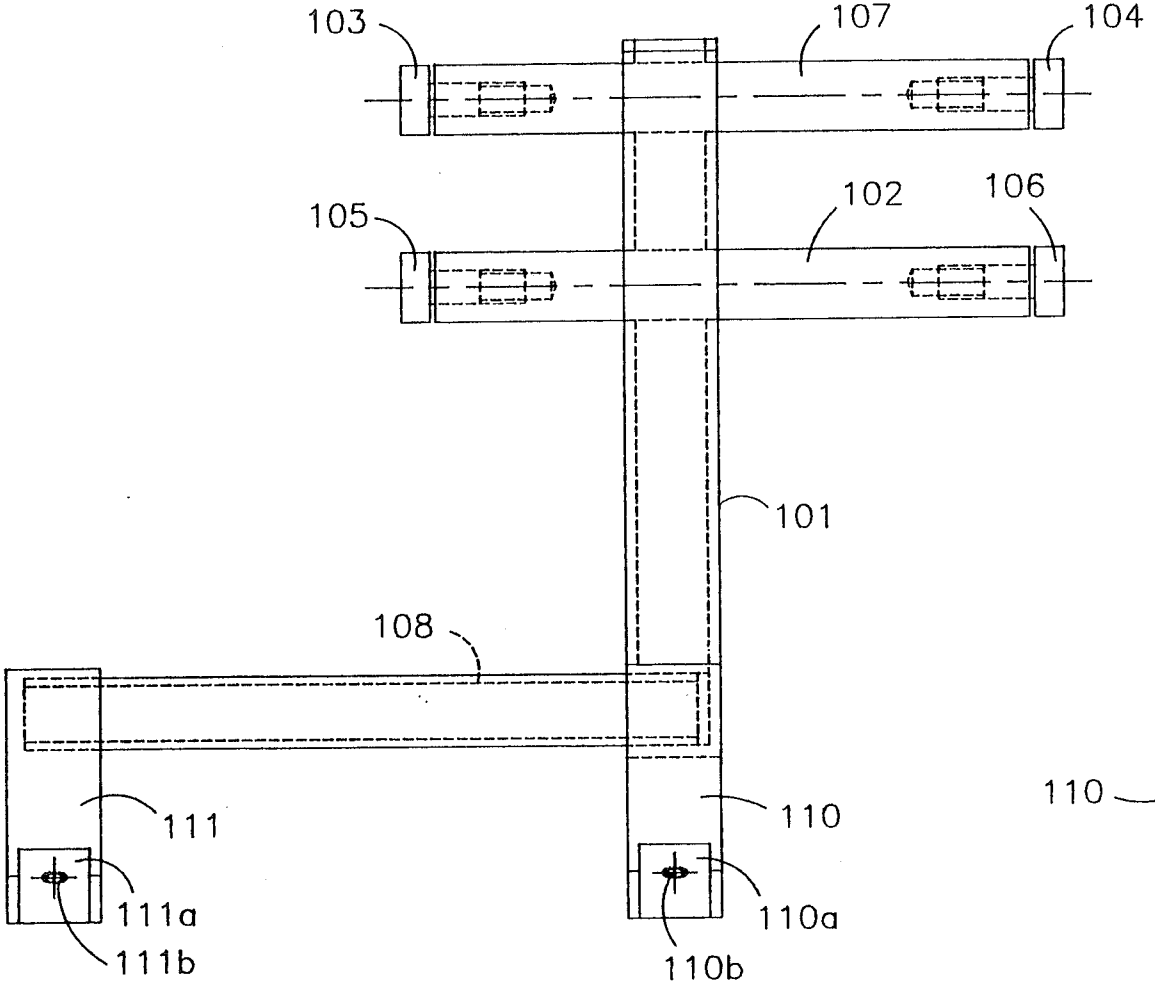
FIG. 3*c* shows a front elevational view of a bucket support.
Figure 3G:
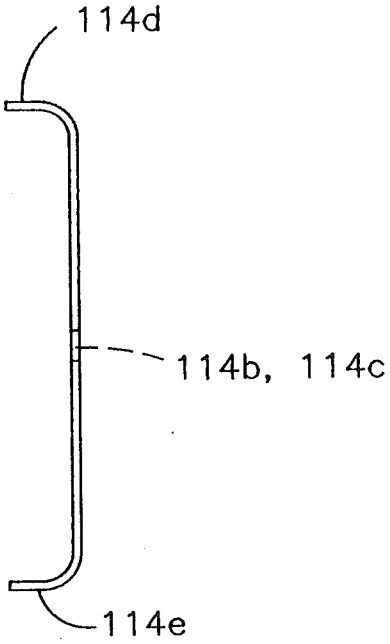
FIGS. 3*e*, 3*f* and 3*g* are side, bottom and end views of one intercept blade shown in FIG. 3*a*.
Figure 3E:
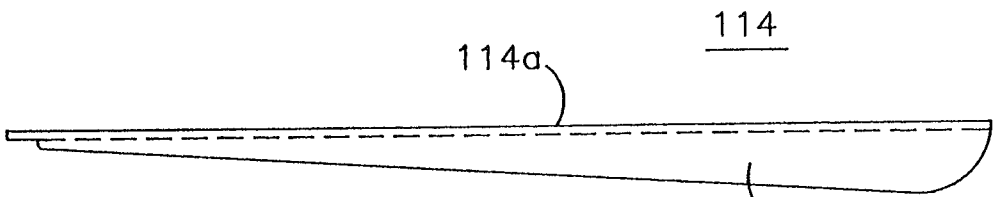
Figure 3F:
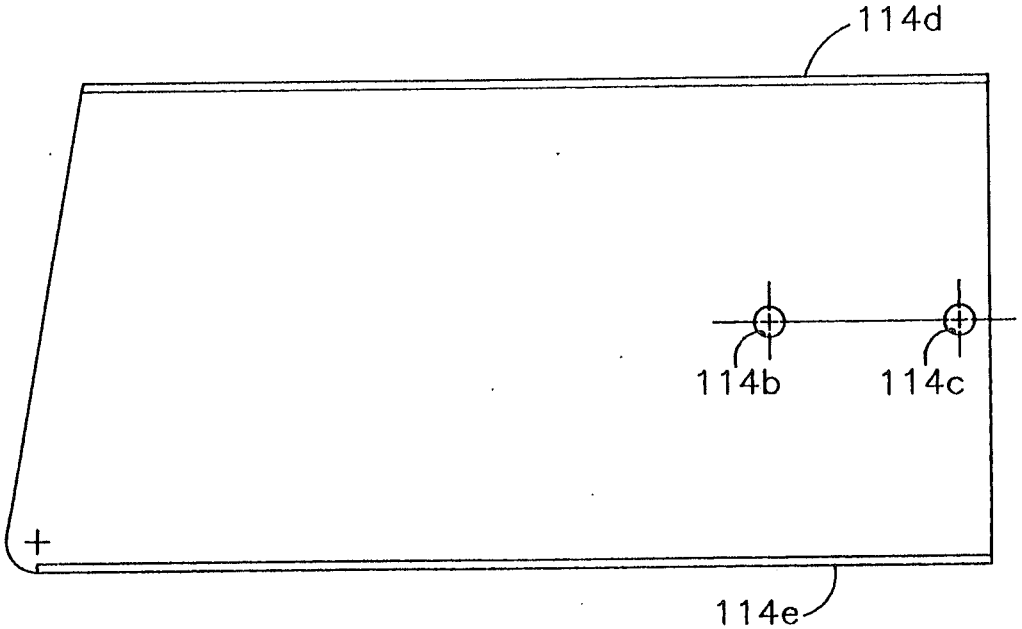

FIG. 2*b* shows the manner in which each bucket is secured to its associated chain drive system. FIG. 2*b* shows, for example, bucket 31-1 driven by chain drive system 50 and 32-1 driven by chain drive system 60. Bucket assembly 31-1 is comprised of a pair of elongated cylindrical rods 101, 102. Each of the rods is provided with free wheeling cam follower rollers at their ends. For example, rod 101 is provided with rollers 103 and 104 and rod 102 is provided with cam follower rollers 105 and 106. A hollow, tubular member 107 of substantially square cross-section is rigidly secured to rods 101 and 102 and extends downwardly therefrom. An integral tubular section 109 (note FIG. 3*d*) is integral with tubular section 107 and extends at right angles therefrom. A hollow, tubular section 110 integral with section 109 extends at right angles relative to section 109. An elongated rod 108 extends to one side of member 110 and has member 111 substantially identical to member 110 rigidly secured to its opposite end as shown best, for example, in FIG. 3*c*. Each of the bracket portions 110 and 111 is provided with a mounting plate portion 110*a*, 111*a*, each having a threaded opening 110*b*, 111*b* for receiving a threaded fastener for securing the intercept blade supporting brackets 112, 113 supporting intercept blades 114, 115, respectively. FIG. 3*a* shows bucket 31-1 with bracket 112 securing intercept blade 114 to bracket portion 110 by fasteners 117. The intercept blades 114, 115 are substantially identical to one another and one such blade is shown in greater detail in FIGS. 3*e*–3*g* as having a main supporting surface 114*a* provided with openings 114*b*, 114*c* for receiving fasteners 117. The intercept blade is formed of a suitable metallic material and is bent along its longitudinal sides to form flanges 114*d*, 114*e* which enhance the supporting strength and prevent the intercept blade from bending.

As can best be seen in FIG. 2*b*, whereas intercept blade 114 of bucket 32-1 is positioned substantially between frames 61 and 62, the bracket portion 111 secured to shaft 108 positions intercept blade 115 offset from frames 61 and 62 and substantially between frames 51 and 52. In a like manner, bucket 31-1 has its intercept blade 114 positioned between frames 51 and 52 while intercept blade 115 is offset from frames 51 and 52 and is positioned substantially between frames 61 and 62. It should further be noted that intercept blades 114 of bucket 32-1 and 115 of bucket 31-1 are vertically aligned and that intercept blades 115 of bucket 32-1 and 114 of bucket 31-1 are similarly vertically aligned. The remaining buckets are arranged in a substantially similar manner. It can thus be seen that the buckets are aligned in such a manner that regardless of the bucket positioned in the intercept position or in the stack receiving position, that all the buckets are aligned to move along a common vertical path which is further in alignment with the longitudinal sides of the signature stream to intercept the signature stream and collect signatures therefrom in an identical manner regardless of whether the bucket is supported by either the left or right-hand drive assembly 50 or 60, respectively.

Figure 4B:
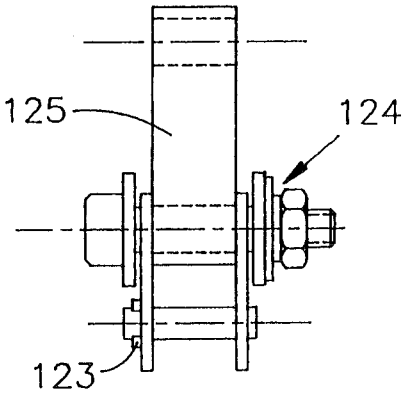
FIG. 4*b* shows the coupling assembly of FIG. 4*a* looking in the direction of arrows A—A.
Figure 4A:
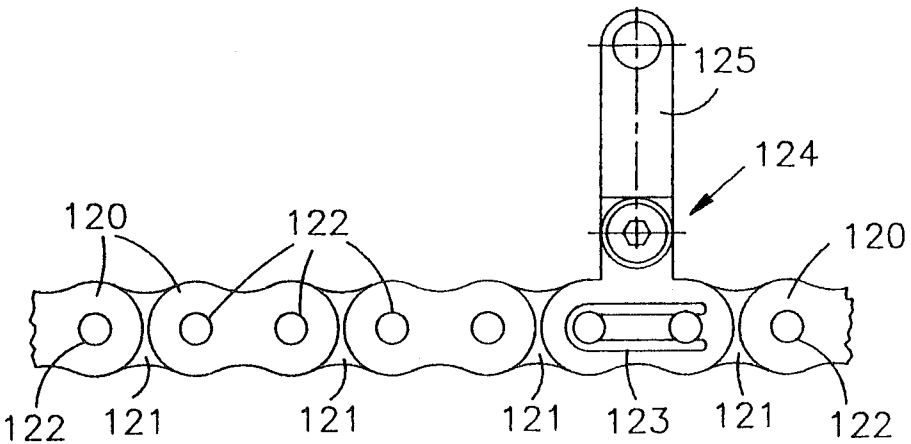
FIG. 4*a* shows a plan view of the linkage assembly for coupling a bucket to an associated drive chain.
Figure 4C:
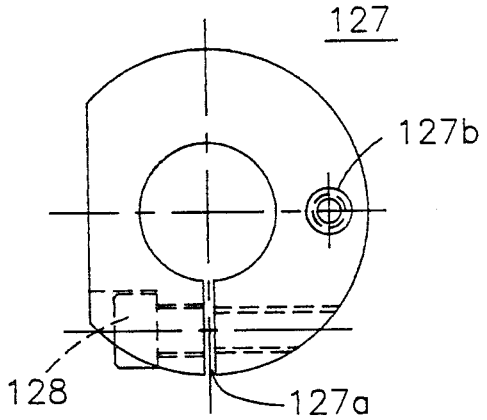
FIG. 4*c* is a side view of one of the collars for coupling a bucket to a chain as shown in FIG. 2*d*.

As was described hereinabove, each bucket assembly is provided with a pair of cam rollers along each side of the bucket assembly for slidably moving within and following the cam recesses provided, for example, within frames 61 and 62. The pair of cam recesses within frames 61 and 62 assures that the buckets associated with the drive assembly 60 follow a precise path as represented by the phantom line 33 shown in FIG. 1. Each bucket is pulled about the substantially oval-shaped path by means of a pair of drive chains cooperating with the associated drive and driven sprockets about which each chain is entrained. FIGS. 4*a* and 4*b* show a small portion of a typical chain comprised of links 120 and 121 coupled to one another by pins 122. A special T-shaped link 123 is coupled to links 121 on opposite sides thereof by pins 122 and is further provided with a fastening assembly 124 for pivotally mounting one end of a solid link 125 whose opposite end is coupled to a pin 126 arranged between a pair of collars 127, one of which is shown in detail in FIG. 4*c* as being a substantially truncated circular-shaped split collar having a discontinuity 127*a* and an opening for receiving a threaded fastener 128 for tightening the collar about shaft 102 to prevent rotation thereof. Opening 127*b* receives pin 126. The chains 129 and 130 pull the two buckets coupled thereto about the substantially oval-shaped path defined by the chains. Link 125 compensates for any differences in the pitch lines of each of the chains and the cam rollers.

Figure 5:
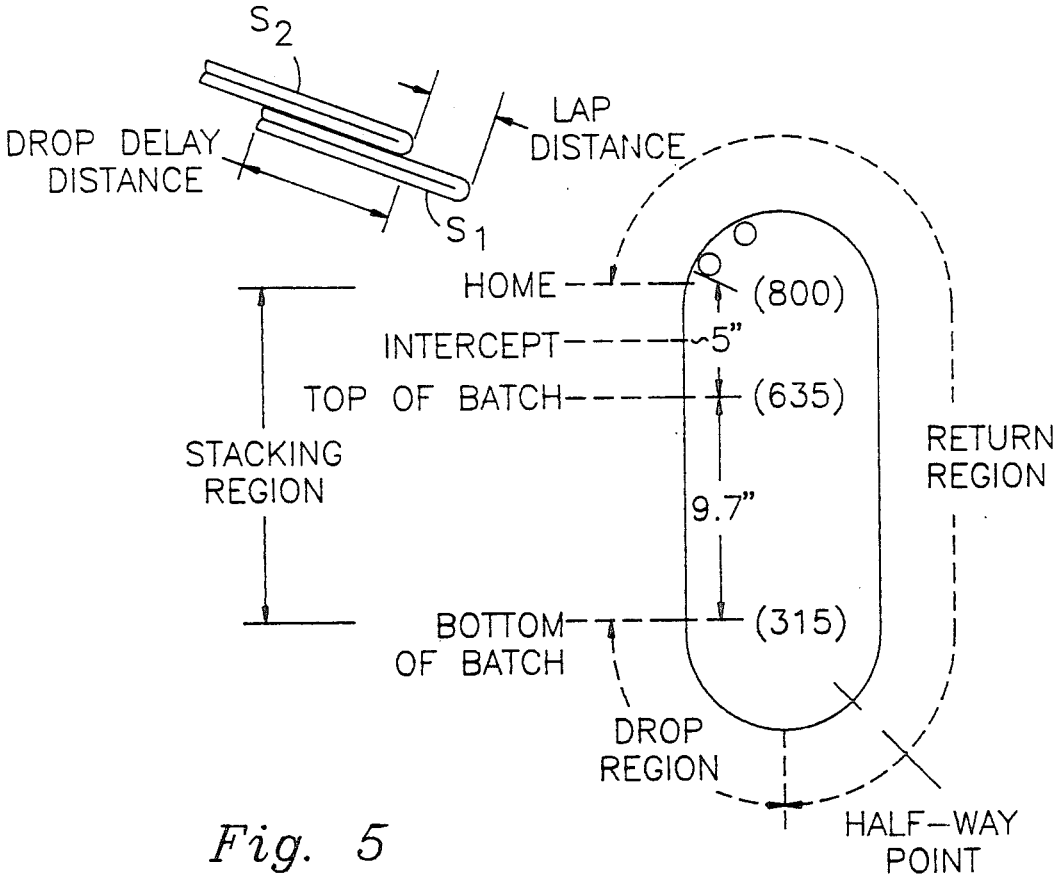
FIG. 5 is a side view of one stacker drive section useful in explaining the manner in which a bucket position is determined.

FIG. 5 shows a diagrammatical view of each of the phases making up a full cycle for each bucket. The home position constitutes the position at which a bucket is poised in readiness for performing an intercept operation and is also identified as the "intercept-ready" position. This position is further recognized by a pair of home position sensors 130 and 131. Sensor 131 is positioned upstream relative to the home position sensor 130. The location of said sensors are shown in FIG. 2*d*. These sensors cooperate to provide an indication that the bucket is in the home position when each of the cam follower rollers 103, 105 of a bucket are respectively aligned with the sensors 131, 130.

Figure 6A:
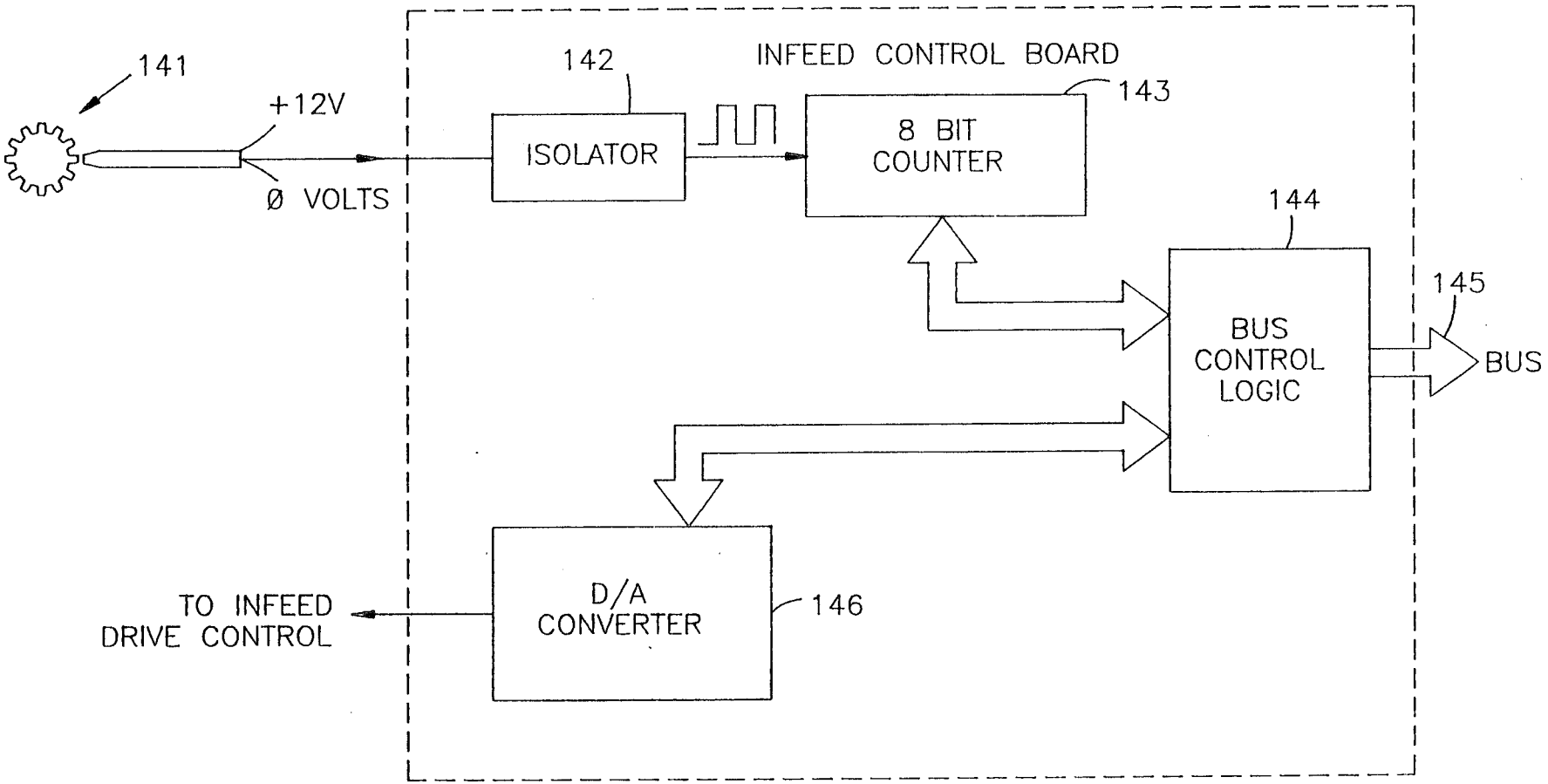
FIG. 6*a* is a block diagram of the infeed section control means.

FIG. 6*a* shows a block diagram of the control means for controlling the stacker infeed drive system.

The control system 140 of FIG. 6*a* includes sensing means 141 responsive to the speed of a press conveyor mounted upstream of the stacker infeed section and, in one preferred embodiment, being capable of generating thirty pulses per inch of conveyor travel, for example. Sensor 141 may, for example, comprise a rotary encoder capable of generating a predetermined number of pulses per revolution responsive to the speed of the press conveyor and may be coupled to a shaft (not shown for purposes of simplicity) rotatably supporting one of the press conveyor rollers.

Figure 6B:
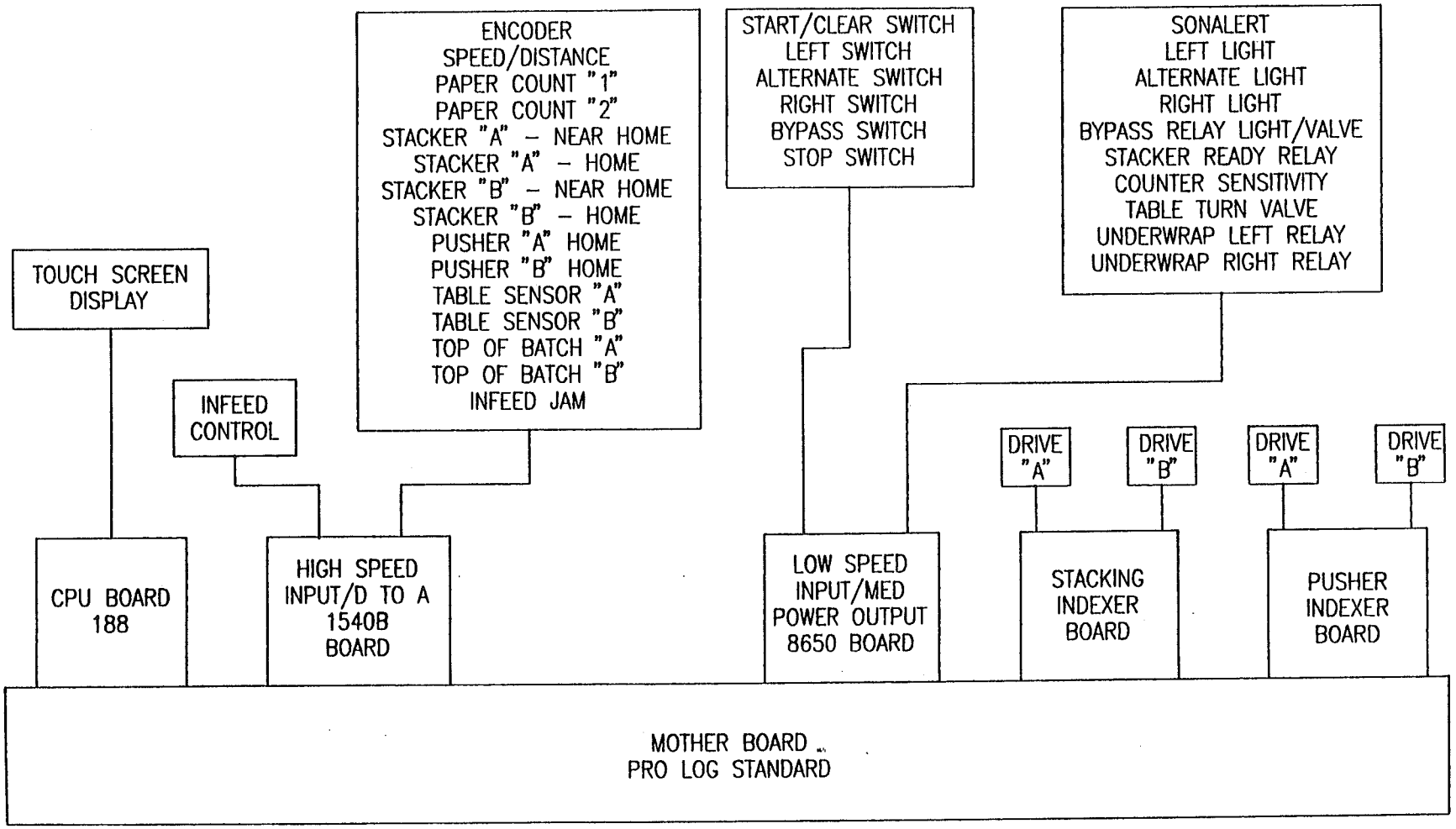
FIG. 6*b* is a block diagram of the stacker electronic control system for controlling the infeed section and the stacking section.

The output of the sensor 141 is coupled to an eight bit counter 143 by way of an isolator device, such as, for example, an opto-isolator 142. Counter 143 is sampled by a microprocessor (CPU) coupled to counter 143 by bus control logic 144 and bus 145. The microprocessor (CPU) is also provided with RAM and PROM memories and a combined touchscreen and display D to facilitate adjustment of the infeed drive, as shown in FIG. 6*b*. The CPU is a Model 188 made by Computer Dynamics. Touchscreen D, which serves as a user interface, is made by Emerald Computer, and is directly coupled to CPU. A bus B, produced by PROLOG, couples the CPU to a high speed interface HS, providing D/A conversion of binary words from the CPU for controlling the input servo motor through infeed control IC. Interface HS also couples the sensors, shown in block S to the CPU through the bus B. The sensors for the table sensors are beyond the scope of this invention and may be ignored for purposes of understanding the present invention. Switches for starting, stopping and clearing the stacker are shown in switch box S2. The right, left and bypass switches deal with the output section and may be ignored for purposes of the present invention. These switches are coupled to the CPU through low speed input/medium power output coupling LS/MP and bus B.

The CPU controls the outputs and displays shown in the box D1, coupled to the CPU by bus B and the medium power output board LS/MP. The Sonalert provides an audible alarm when a problem occurs, such as a failure of a batch carrier to reach home when an 800 count is decremented to zero. The stacker ready relay operates when the stacker has been turned on and initialized. The remaining outputs may be ignored, for purposes of the present invention. The stacker stepper motors are driven by the CPU through bus B, an indexer board I and a drive circuit D3 or D4. The pusher indexer board and table drives may be ignored for purposes of the present invention. The sampled count is read by the CPU and converted to an indication of conveyor speed.

A program routine examines the sampled value and compares it to the minimum speed reference stored in memory. No action is taken if the conveyor speed is less than the infeed minimum speed. However, as conveyor speed increases, the program reacts causing the infeed speed to follow the press conveyor speed.

The touchscreen entry allows the operator to scale (Gain) the response of the infeed section to speed changes. An entry of 100 (Default) causes the infeed to follow a one-to-one ratio for speeds above minimum speed. By keyboard operation it is possible to accept entries from 80 to 120 which allows for a range of plus or minus twenty percent ±20%) change in the speed relationship between conveyor speed and infeed section speed. More specifically, by appropriate touchscreen input, the infeed speed may vary in the range from 80 percent to 120 percent of the press conveyor speed with the Default speed being 100 percent. For a setting of 80 if the press speed increases by 1.0'/sec. then the infeed section will increase by 0.8'/sec.

The system is an open loop-type speed control which is satisfactory for this application. However, the system is preferably calibrated when manufactured to adjust the Gain of the motor drive amplifier.

The minimum infeed speed entry is in feet per minute and entries are accepted in the range from 160 to 200 with a Default value of 180. However, the system is capable of retaining a customer preferred value. The control interprets an entry by outputting a binary 60 to the digital-to-analog converter 146 through bus 145 and bus control logic 144 to provide an output of approximately five volts for application to the infeed section motor which is a DC servo-motor. The scale for this system is four to three.

As was mentioned hereinabove, the Gain entry will default to 100 percent and can be altered by the operator through a range of plus or minus twenty percent (±20%) with the customer's preferred entry being maintained. To obtain similar effects on infeed speed or minimum speed, a scaling factor is required. The speed sensor 141 of the mating conveyor is preferably a digital pulser capable of producing approximately 1,000 pulses per second (specifically 1,080 pulses) at a speed of 180 feet per minute. Assuming a sampling time for counter 143 of sixty milliseconds (60 ms) a direct relationship to pulses per sample is obtained for the digital word required by the digital-to-analog (D/A) converter 146.

FIG. 5 shows the significant points along the path of travel of each batch carrier as follows:

A batch carrier in the home position has the tips of its interceptor blades positioned immediately above the signature stream and is sufficiently close to the signature stream to move into the intercept position in a rapid manner and yet sufficiently displaced therefrom to permit free flow of signatures beneath the batch carrier in the home position for delivery and collection by the next downstream batch carrier which is driven by a chain drive system different from the batch carrier at the home position. When the proper number of signatures has been delivered to the batch carrier moving through the stacking region, the batch carrier in the home (intercept-ready) position is rapidly moved to the intercept position by operating stepper motor M1, for example, to rapidly accelerate the batch carrier from the home position to the intercept position. The batch carrier moves through a variable stroke to intercept the signature stream, the length of the stroke being dependent upon the number of pages of the signatures being stacked, which value is inputted into the system prior to a stacking operation, as will be more fully described.

After movement to the proper intercept position, both bucket drive systems are abruptly halted for a predetermined time delay referred to as a "drop delay" which is designed to allow the last paper of the stack being formed to reach and be properly located upon the completed stack. The drop delay is a function of the speed of signatures moving through the infeed section and is equal to the number of speed distance units required for the last signature to be stacked shown as S1 (see FIG. 5) measured from the leading edge of the intercepted signature S2 to the trailing edge of signature S1, which is nominally six inches. Thus, the drop delay is typically the number of speed distance units required to equal six inches or the length of a signature measured in the feed direction less the lap distance.

Upon termination of the variable drop delay interval, the bucket which has intercepted the signature stream is then moved through the stacking region while the bucket whose stack has been completed enters into the drop region. A bucket entering into the drop region is accelerated to move faster than the free fall speed of a batch in order to drop ,the formed batch upon the outfeed section 40 so that the formed batch lands squarely upon the surface of the outfeed section regardless whether the batch is of the broad sheet or tabloid makeup, the drop speed being determined by the nature of the batch, which data is keyed in through the touchscreen prior to initiation of a stacking operation.

Each bucket moving through the stacking region is moved through a predetermined initial distance to allow sufficient clearance for the bucket located at the home position to undergo an intercept movement so as to prevent any interference between the adjacent buckets. Thereafter, the bucket moves downward until the batch is fully formed whereupon the delivery of further signatures to the bucket moving through the stacking region is terminated by movement of the bucket in the home position to the intercept position.

The bucket in the stacking region is moved downwardly just enough to minimize the vertical drop distance experienced by each signature as it is advanced from the infeed section to the bucket in the stacking region collecting signatures.

A top-of-batch sensor monitors the space above a forming batch and should this region become crowded, the stacking section is caused to move downward at an increased rate to provide adequate relief. If the situation becomes serious, i.e. if the signatures become more compressed, a clear cycle is initiated, as will be more fully described.

The movement of a bucket through the stacking region is a function of the speed of the signature stream and the actual flow of signatures in order that the system be responsive to interruptions in the signature stream at the low speed end as well as to movement of a continuous signature stream at the high speed end.

Control of the above movements will now be considered in greater detail.

Intercept

The intercept motion is the first motion imparted to the bucket at the home position at the beginning of a cycle and is initiated from the "home" position. The bucket undergoes rapid movement which is sufficient to move the blade tips of the interceptor blades to a position to intercept the signature stream of closely spaced signatures arranged in a "shingle" or imbricated fashion. The length of the intercept stroke is a function of paper thickness, which parameter is entered by the operator during the set-up operation of the stacker by a touchscreen entry. The preferred system has five stroke lengths provided to accommodate the range of product thickness, the smallest stroke being for papers of fifty or less pages and the largest stroke for papers made up of two hundred or more pages, with each of the intervening stroke values covering a fifty page range, according to the following chart.

First Intercept Range—$T_1$

T<50 Pages

Second Intercept Range—$T_2$ 50 pages<T<100 pages

Third Intercept Range—$T_3$ 100 pages<T<150 pages

Fourth Intercept Range—$T_4$ 150 pages<T<200 pages

Fifth Intercept Range—$T_5$ 200 pages<T.

So long as the stacker is counting and stacking signatures of a predetermined page thickness, the variable stroke is maintained. The variable stroke may be adjusted when running signatures of a thickness outside of the present range set into the stacker by the touchscreen.

Settling Delay (Drop Delay)

Immediately upon movement of the bucket from the home position to the intercept position, the drives for both sets of buckets are halted for a period of time sufficient to allow the signature on the last batch being formed to become aligned with the previous signatures of the same stack. The settling delay is a function of infeed speed and is determined by the number of pulses necessary to move the last signature of a stack a distance equal to the length of the signature measured in the feed direction minus the nominal spacing between the leading edges of the last signature and the adjacent upstream signature, said distance typically being of the order of six inches. The drop delay length is shown in FIG. 5. The drop delay is thus equal to a time duration determined by the number of speed distance units to equal six inches.

Batch Forming

The batch forming motion begins upon the conclusion of the settling delay interval, it being understood that the bucket in the intercept position begins to move through the batching region (also referred to as the "stacking region") and simultaneously therewith the bucket carrying the last completed batch initiates a drop cycle which will be more fully described hereinbelow.

Regardless of how thin the signatures may be and regardless of the very small number of signatures in a completed batch, it is still necessary to drive the bucket from the intercept position to a position which allows sufficient clearance for the bucket now in the home position to move to the intercept position for collecting the next batch. The associated chain drive system is thus operated to move the bucket to a position a predetermined distance below the paper entry level even if there is an interruption in the signature stream. As the signatures are counted, however, the bucket moves downwardly to accommodate the space required by the forming batch. The carrier section moves downwardly until the batch is fully formed. The termination (i.e. quantity) of the batch being controlled by the next intercept operation or when the bucket reaches a position near the bottom of the stacking region, as in the case of a very large batch of signatures.

A top of batch sensor 148 (see FIG. 1) is positioned to monitor the space above the formed batch and, should this space become crowded, the stacking bucket is caused to move downwardly at a rate more rapid than its present speed to provide relief of the crowded condition. If the crowding situation becomes serious, a clear cycle will be initiated in an effort to continue stacker operation.

Drop Cycle

The drop cycle motion is initiated by the bucket having a completed signature batch upon the conclusion of the settling delay. The motion usually begins while the carrier is still moving downward at batching speed, but the carrier may also be stopped when the cycle begins such as would occur if the signature stream were interrupted immediately after intercepting a paper.

The bucket having the completed batch accelerates rapidly upon initiation of the drop phrase, quickly reaching the correct speed for dropping. Near the end of the drop phase and after the intercept blades and the batch of signatures are clear of one another, the bucket decelerates as it moves from the drop region and through the return region to return to the home position along the rearward side of the stacking section.

The drop characteristic can be modified by an operator by entering values through the touchscreen D so that the formed batch drops squarely upon the batch receiving platform regardless of broad sheet or tabloid makeup. The object of the drop cycle is to move the bucket supporting the completed batch out from beneath the batch by accelerating the bucket to a speed which causes it to move faster than the free fall speed of the batch. However, it is important to orient the batch so that it is caused to fall squarely upon the outfeed stacking section once the supporting bucket moves out from beneath the batch, allowing the batch to fall squarely upon the outfeed stacking platform. The drive pulses are thus applied to the stepper motor to obtain the proper speed profile for the drop cycle.

Clear Cycle

The clear cycle is initiated either by the operator or responsive to a machine-sensed input. The clear cycle affects the entire stacker but, for purposes of simplicity, the description herein will be limited to the batching section, it being understood that the clear cycle will also function to reset and initialize the stacker infeed and outfeed sections, as is conventional. The clear cycle is initiated with an intercept. However, since it is possible that a clear cycle is initiated during the time that neither bucket from the side-by-side systems is at the home position, a clear cycle cannot be immediately responded to during such an interval. However, a clear cycle is initiated as soon as a bucket moves to the home position, regardless of the bucket drive system associated therewith. Once initiated, the stacking section completes a clear cycle in approximately one second. A full clear cycle is comprised of batch complete, stack complete and then a "falsified" first paper followed by batch complete, stack complete making batch carrier ready for the first paper of the next stack.

Initialization

When the stacker start button is pushed, initialization of the stacker occurs, which operation consists of a control routine which places the independent groups of buckets in proper relationship to the infeed and to one another. The routine places the sets of buckets in the proper orientation such that one bucket of one of the sets of buckets of drive system 50 is moved to the home position in readiness to intercept a signature while one bucket of the other set of buckets of drive system 60 which is immediately downstream relative to the bucket in the home position is moved to a position approximately five inches below the home position (referred to as a "full stroke"), ready to collect signatures.

Batching Routine

The batching routine consists of two major parts, namely the program that calculates bucket speed in inches per second and the program that determines when to drive the carrier.

The calculation routine determines the speed by performing the following calculation:

*Speed (Inches Per Second) = Pages Per Paper × 6 Divided By Time Interval Between Papers In Milliseconds*

The time interval between signatures is an average of the actual measurement preferably taken over a five signature period with a lower limit being imposed on the result. The results of the calculation program are critical to smooth stacking performance and, therefore, the system must function well under the following conditions:

1. A uniform stream of signatures which is the easiest condition to work with, and
2. A broken or interrupted stream which may be created by removal of check copies, slug delivery or irregular delivery due to a stuffer, i.e. apparatus employed for stuffing an insert or inserts into each signature of the signature stream, which may cause such irregularities in the stream.

The program consists of the following elements:

1. A timer to measure separation time between signatures;
2. A five stack queue for storing time intervals; and
3. An average measurement.

Figure 7A:
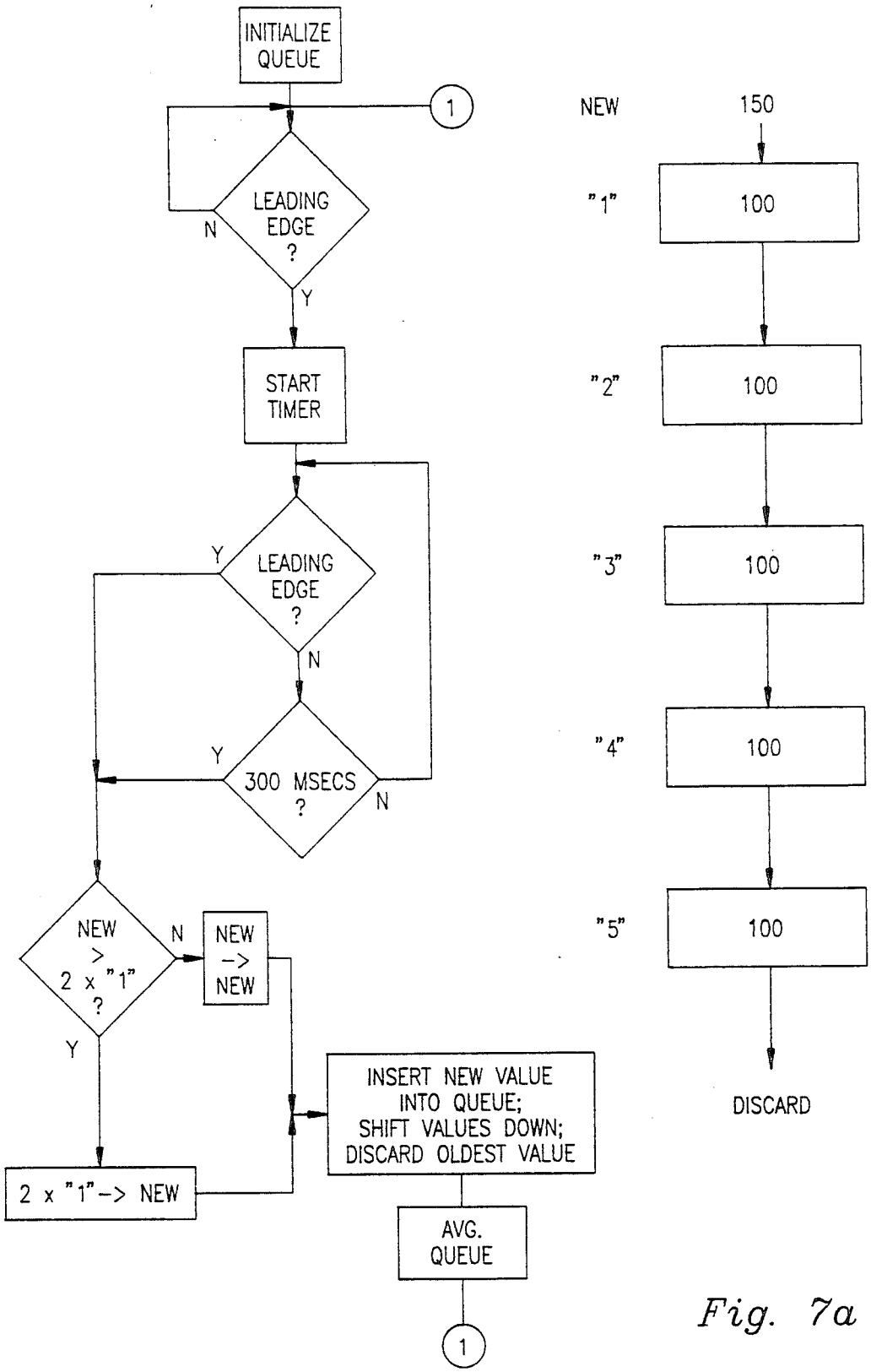

The sensor, which may be part of the counting device 27 shown in FIG. 1, detects the folding leading edge of a signature causing the timer to be initiated. The timer accumulates elapsed time until the folding leading edge of the next upstream signature is detected or until the timer reaches a value of 300 milliseconds. Each time a signature is detected, the contents of the timer is loaded into the queue stack where it replaces the oldest value. FIG. 7 shows the flow diagram of the calculation cycle.

The queue stack is initialized by placing a common value of 100 milliseconds in each cell "1" through "5" of the five stack queue. The system continues to look for a folded leading edge. Upon the occurrence of a folded leading edge, the timer is initiated. Thereafter, the system continues to monitor the signature stream and the timer looking for the next leading edge and respectively looking for the timer to accumulate an elapsed time of 300 milliseconds. Whichever of these events occurs first, the timer value, which is the next entry to be made into the queue, is then compared with the previous entry. If the new entry is more than twice the previous entry, then the new entry is converted to a value equal to twice the previous entry and is entered into the queue stack at location "1". If the new entry is not greater than twice the previous entry then the new entry is not changed. Each of the entries into the queue stack are shifted downwardly into the next storage or memory cell. The value in stage "5" (the "oldest" value) is discarded. Immediately after the new value is loaded, the sum of the five cells is averaged and this value is employed in the speed calculating program.

Due to the five cell averaging technique and deceleration limiting (twice value), the rate calculation is fairly insensitive to breaks or interruptions in the signature stream while at the same time it is quite responsive to the increases in the speed of the signature stream. The queue stack may be altered to a greater or lesser number of cells than five, if desired.

Once the speed value is calculated, its results are used by a routine which turns on and off the bucket drive associated with the bucket moving through the stacking region.

Carrier Off/On Routine

Immediately after the conclusion of the settling delay, the bucket moved to the interrupt position will now be moved at a speed calculated by the rate routine described hereinabove or by a minimum speed value, whichever is greater (see flow diagrams of FIGS. *7b* and *7c*). Once the bucket movement is initiated, the bucket will be caused to run at that speed until it reaches a safe position unless:

(a) the top of batch limit is exceeded; or (b) a clear cycle is initiated; in which case a bucket will be caused to drive faster due to the intervention of another program.

Once the bucket has reached the safe position, it may stop or continue based upon the following criteria:

(a) A bucket will continue to drive if the actual position is not greater than the planned position.

(b) In addition to the above, the speed of a bucket may be altered after reaching a safe position. Since the rate calculation routine is executed each time a signature is sensed, the result may either increase or decrease on a paper-by-paper basis. The routine which starts and stops the batching motion operates much faster, being controlled by a timer to operate at intervals of several milliseconds, at which time the routine is called, and is caused to employ the last value calculated by the rate routine. So long as the bucket does not get ahead of the planned position, the carrier will continue to move downwardly responding to speed changes as indicated by the rate calculation. On the other hand, if the actual position is greater than the planned position, the bucket will be halted until the routine is again called when the time interval elapses.

Top-of-Batch Limit

In most cases, the action of the rate of drive routine satisfies the space required by incoming signatures. However, if the signature rate is accelerating rapidly or the signatures are thicker than the set up allows for, the space for stacking signatures may become crowded, and if so, the top of batch limit switch may be activated.

The program (FIG. *7e*) continuously monitors the position of the top-of-batch sensor except during the intercept interval. The top of batch sensor is capable of generating either one of two abnormal levels of output. The first level will cause the stacking section to travel at a speed which is twenty-five percent faster than that indicated by the rate calculation. If the second level of output is reached, indicating a more severe crowding condition, the stacking section speed is increased to the maximum speed, which in one embodiment is fourteen inches per second. Constant monitoring of the top of batch sensor will remove the additional speed as soon as pressure is relieved from the sensor. If batch carrier is at its final travel and the top-of-batch is still activated to its maximum travel, a clear cycle is executed.

Continued activation of the top of batch control routine indicates a problem with either the system hardware or the set up parameters. The screen will display the status of this routine so that corrective measures may be taken. However, occasional activation does not indicate a problem.

Figure 7E:
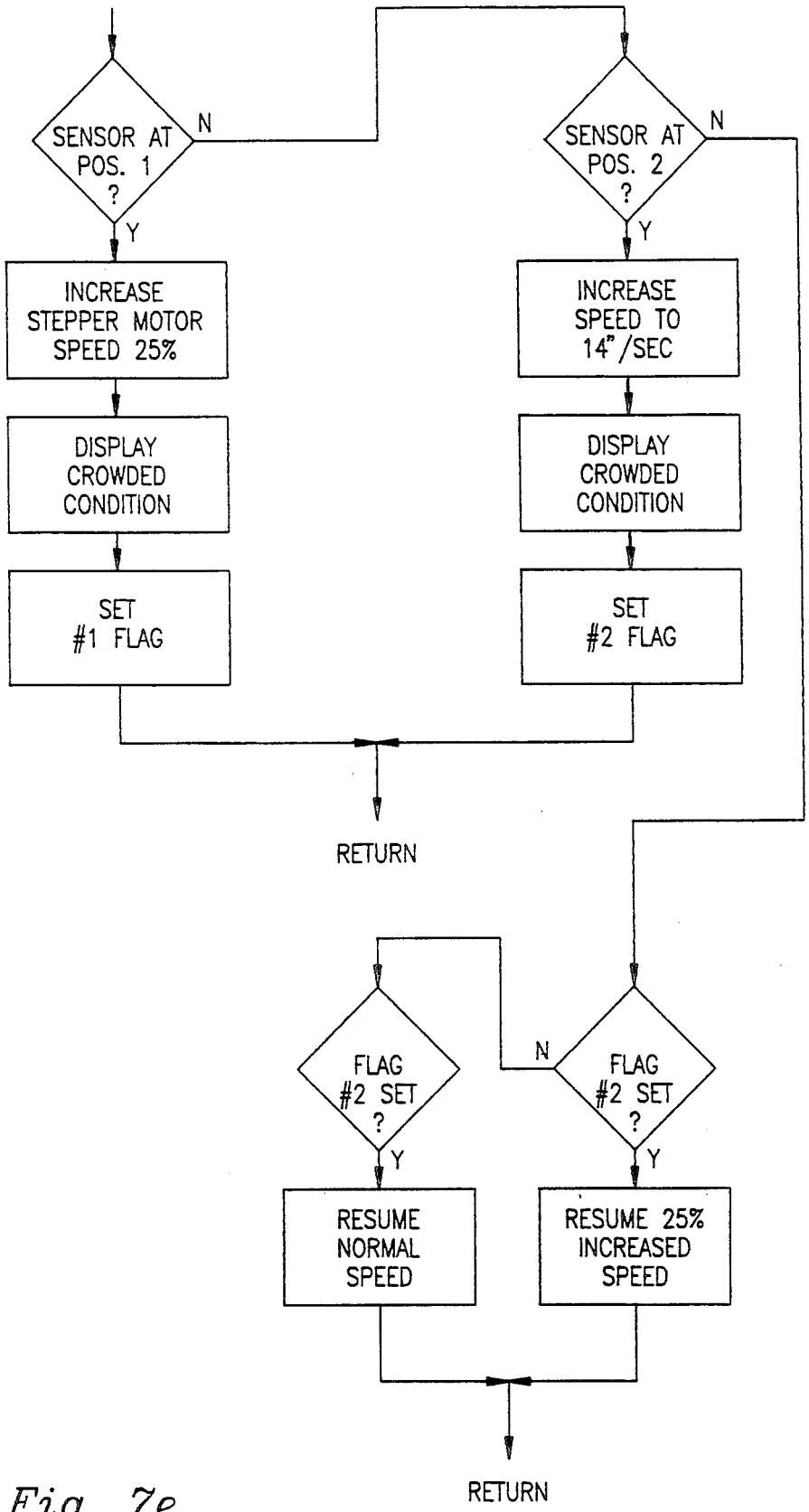

The top-of-batch sensor as shown in FIG. 1 is comprised of an elongated plate 180, pivoted at its upper end 180*a* and positioned just above the signature stream in the infeed section. Sensor 148 positioned near the lower end is movable in generally a diagonally upward position responsive to a crowded stacking condition, i.e. a condition in which the signatures being collected upon a bucket in the stacking region are accumulated to a height which is greater than the height of the infeed path, causing a crowding condition. If the first limit 181 (POS. "1") is reached, the speed of the bucket experiencing the crowded condition is increased by twenty-five percent (25%) (FIG. 7*e*). In the event that the second (more severe) crowding condition occurs, i.e. the plate 180 moves to position 182 (POS "2"), the bucket is moved at a maximum speed of the order of fourteen inches per second or clear cycle may be activated. If the crowding conditions persist, the stacker may be halted and the initial conditions reset to accommodate the crowding conditions. However, if these conditions occur only occasionally, there is no need to reset the set up parameters.

Each bucket is monitored to determine its progress from the home position through a full cycle of intercept batching batch drop and return to home system generates pulses identified as distance pulses, each pulse representing a set travel distance. In the preferred embodiment, the distance around drive chain path is 34 inches. This path length is divided in half since there are two buckets arranged at equal distances from one another. This half distance is represented by 800 pulses. More specifically, application of 800 pulses moves a bucket from the home position to a point half-way around the closed-loop path. At the time that 800 pulses have been applied to the stepper motor, the other bucket will advance from the half-way position to the home position. A bucket in the home position causes loading of 800 pulses into a counter 162 or 164 (FIG. 8). The count of stepper pulses is decremented as the bucket moves from the home to the intercept position. The distance from the home position to the top of batch position is typically five inches and is represented by 165 pulses. The length of a typical stroke from the home to the intercept position is of the order of forty-five to fifty pulses. The distance from the top of batch to the bottom of batch is of the order of 9.7 inches represented by 320 pulses.

The system applies pulses to the motors M1 and M2, at the same time decrementing the counters 162, 164 and constantly looks for the home position by monitoring home position sensors 130, 131 (FIGS. 2*d* and 7*d*). When a counter is counted down to zero, the home position sensor is monitored and if a bucket for that chain drive has not arrived at the home position, the CPU shuts down the stacker. Alternatively, when the counter counts down to zero if the home sensors each fail to detect an associated one of the cam follower rollers of a bucket, the chains are driven through an additional predetermined distance of one inch (1"), for example, and the home sensors are again examined. If the cam follower rollers are not aligned with the home sensors, the CPU shuts down the stacker.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A method for operating a stacker for batching signatures delivered to the stacker in a stream, said signatures being arranged in imbricated fashion and said stacker including first and second bucket means for receiving and collecting signatures, said method comprising the steps of:

moving said first bucket means to a home position immediately above the signature stream;

abruptly moving said first bucket means a predetermined distance from said home position to intercept said signature stream upon the occurrence of a predetermined condition, said predetermined distance being a function of the thickness of the signatures being batched;

moving said first bucket means along a stacking region at a rate responsive to the speed of the incoming stream;

moving said second bucket means to said home position as said first bucket means is moving through said stacking region whereby the signatures from said stream continue to be collected on said first bucket means;

rapidly accelerating sa-id second bucket means to intercept said signature stream and thereby terminate the collecting of signatures on said first bucket means;

abruptly halting said first and second bucket means to allow the last signature delivered to said first bucket means to settle on the batch being formed;

moving said first bucket means in a drop region out from beneath the batch deposited thereon to permit said batch to fall upon a collection surface located beneath the stacking region.

2. The method of claim 1 wherein said step of moving said first bucket means out from beneath the batch deposited thereon further includes:

moving said first bucket means in a manner to cause the batch deposited thereon to fall squarely upon said collection surface.

3. The method of claim 1 further comprising the step of:

moving said second bucket means downwardly through said stacking region to a safe position which will allow the next bucket means to occupy the home position to move to the intercept position without crowding the signatures collected on said second bucket means.

4. The method of claim 3 wherein said second bucket means is moved to said safe position at a predetermined minimum velocity.

5. The method of claim 4 wherein said minimum velocity is determined responsive to the speed of movement of signatures in said incoming signature stream and the thickness of said signatures.

6. The method of claim 5 wherein the average velocity of the incoming signature stream measures over a predetermined number of successive signatures is calculated; and said average value is compared against said minimum velocity and the second bucket means is moved at whichever of the two velocities is greater.

7. The method of claim 1 wherein said stacker further comprises first and second stepper motor means, said method further comprising the steps of:

applying pulses to said first and second stepper motor means at a rate responsive to the speed at which it is desired to respectively move said first and second bucket means;

counting the number of pulses applied to each of the stepper motor means through a full cycle of motion about a closed-loop path from said home position through said stacking region, said drop region and the return to said home position in readiness for the next intercept operation; and halting the driving of said first and second stepper motor means in the event that a bucket means whose stepper motor pulses have reached a predetermined count has not returned to the home position.

8. The method of claim 7 wherein the step of halting one of the stepper motor means further comprises the step of:

moving the bucket means which has not reached the home position through a short predetermined distance and thereafter halting both of said stepper motor means in the event that the bucket means moved through said short predetermined distance has not been moved to said home position.

9. The method of claim 7 further comprising the steps of:

determining a planned distance value which is function of the speed of signatures in said signature stream and the thickness of said signatures;

determining an actual distance value which is a function of the number of pulses applied to that one of said first and second stepper motor means whose associated bucket means is in the home position to move its associated bucket means from the home position, said count being measured during the period that the bucket means is moving through said stacking region; and halting the application of pulses to that one of the first and second stepper motor means whose associated bucket means has been moved from the home position when said actual distance value is greater than said planned distance value.

10. A method of stacking signatures delivered to stacking bucket means movable about a closed-loop path by stepper motor means, said signatures being delivered as a stream of signatures arranged in imbricated fashion, comprising the steps of:

applying pulses to said stopper motor means to move said bucket means to a home position adjacent to and above the signature stream;

applying additional pulses to said stepper motor means sufficient to move the bucket means to an intercept position a variable distance downstream from the home position, said variable distance being a function of the thickness of the signatures;

determining a planned distance value which is function of the speed of signatures in said signature stream and the thickness of said signatures;

determining an actual distance value which is a function of the number of pulses applied to said stepper motor means to move said bucket means from the home position, said count being measured during the period that the bucket means is moving through said stacking region; and halting the application of pulses to said stepper motor means when said actual distance value is greater than said planned distance value.

11. The method of claim 10 further comprising the step of:

continuing the application of pulses to the stepper motor means when the planned distance value of the associated bucket means is greater than the actual value.

12. A stacker apparatus for forming batches of signatures delivered to said stacker apparatus in a substantially continuous stream, said signatures being arranged in imbricated fashion, said apparatus comprising:

bucket means;

closed-loop cam means defining a closed-loop path including a first substantially linear path portion defining a stacking region for guiding said bucket means downwardly therealong, a second linear path portion arranged substantially parallel to said first linear path portion, substantially semi-circular path portions linking said linear path portions at their upper and lower ends and a home position located on the semi-circular path portion arranged above said stacking region;

motor means for moving said bucket means about said closed-loop path;

means for guiding said incoming signature stream in a substantially diagonal downward direction along a delivery path which intersects said closed-loop path at the top end of said first linear path portion;

said bucket means having intercept blade means with free ends for intercepting the signature stream;

coupling means for coupling said bucket means to said motor means;

control means for operating said motor means to move said bucket means to said home position where its intercept blade means is located just above the path of said signature stream;

said bucket means including cam follower means cooperating with said cam means and being located in the semi-circular path portion adjacent to the upper end of said first linear path portion when said intercept blade means is in the home position; and said control means including means for operating said motor means for accelerating the bucket means from a standstill at said home position to an intercept position, whereby said bucket means is moved along said semi-circular path before entering said first linear path portion to move said free ends at a velocity greater than the velocity of said coupling means to enhance the intercept of the signature stream by said intercept blade means.

13. The apparatus of claim 12 wherein said motor means includes stepper motor means and said control means includes means for generating stepper motor pulses at a rate commensurate with the desired acceleration.

14. A stacking apparatus for stacking signatures delivered to said stacking apparatus in a substantially continuous stream of signatures arranged in imbricated fashion, said apparatus comprising:

first and second bucket means;

first and second drive means arranged in side-by-side fashion for respectively during said first and second bucket means;

each of said drive means further including stepper motor means;

control means for independently operating the stepper motor means of said first and second drive means;

said control means comprising means for moving one of said first and second bucket means to a home position located just above said signature stream while the other of said first and second bucket means is below said signature stream for accumulating signatures;

means responsive to a predetermined signature count for rapidly moving the bucket means at said home position to an intercept position to intercept the signature stream and halt the flow of signatures to the bucket means accumulating batch signatures, the distance between said home position and said intercept position being a function of signature thickness;

means for halting the application of drive pulses to each of said stepper motor means for a time delay sufficient to allow the last signature to be delivered to the downstream bucket means to settle on the accumulated batch of signatures;

means for moving the bucket means downstream of the bucket means in said intercept position about a lower curved path portion at a rate sufficient to move said bucket means out from beneath the batch of signatures supported thereon to drop in a free-fall fashion upon a collection surface;

said movement about said lower curved path portion being controlled to assure that the batch, when dropped, is oriented in such a manner as to fall squarely upon the collection surface;

said control means including means for operating said stepper motor means controlling the bucket means in the intercept position for moving the last-mentioned bucket means at a rate sufficient to prevent signatures being collected thereon from being crowded between said last-mentioned bucket and the next bucket means to be moved from the home position to the intercept position.

15. The apparatus of claim 12 wherein said control means further comprises means for operating the motor means for initially moving the bucket means moving at a predetermined speed through the stacking region to a predetermined safe position and thereafter for moving the bucket means at a rate responsive to the average rate of movement of the predetermined plurality of signatures delivered to said stacker apparatus after the associated bucket means has moved to a predetermined safe position.

16. The stacker apparatus of claim 12 further comprising movable top of stack sensor means positioned above said signature stream; said control means including means responsive to movement of said sensor means to a first location due to crowding of signatures being delivered to said stacker apparatus for increasing the speed of the bucket means moving through said stacking region by a predetermined amount.

17. The apparatus of claim 16 wherein said predetermined amount is twenty-five percent greater than the speed of movement of said bucket means before said increase.

18. The apparatus of claim 16 wherein said top of stack sensor means is movable to a second position responsive to further crowding of signatures and said control means further comprises means responsive to movement of said top of stack sensing means to said second position for increasing the speed of the bucket means receiving signatures to a predetermined maximum speed.

19. The method of claim 6 wherein the step of determining the average value of the signature stream comprises the steps of:

(a) storing a predetermined nominal value in each of a plurality of cells forming a queue stack, said cells being arranged to provide an input cell, an output cell and a plurality of intermediate cells arranged between said input and output cells;

(b) starting an interval timer responsive to the leading edge of a signature passing a predetermined location;

(c) inserting the elapsed time value accumulated by the interval timer into the input cell responsive to the leading edge of the next signature passing said predetermined position;

(d) moving the values stored in each memory cell of the queue stack to the next cell and discarding the value removed from the last cell of the queue stack; and (e) calculating the average of the values in the memory cells of the queue stack.

20. The stacker apparatus of claim 12 further comprising movable top of stacker sensor means positioned above said signature stream and above said stacking region;

said control means including means responsive to movement of said sensor means to a first location due to growth of a stack on the bucket means causing the top of the accumulated stack to move upwardly at a rate faster than the downward movement of the bucket means causing crowding of signatures on the bucket means, to thereby increase the speed of the bucket means through the stacking region by a predetermined amount.

21. The stacker apparatus of claim 12 wherein said bucket means intercept blade means comprises rigid members for supporting and collecting signatures delivered to said bucket means.

* * * * *

UNITED STATES PATENT AND TRADEMARK OFFICE

CERTIFICATE OF CORRECTION

PATENT NO. : 5,114,306

DATED : May 19, 1992

INVENTOR(S) : Christer A. Sjogren - Louis D. Kipp - William K. Moritz

It is certified that error appears in the above-identified patent and that said Letters Patent is hereby corrected as shown below:

Column 12

Line 67, before "±" insert --(--

Column 20

Line 37, change "sa-id" to --said--

Column 21

Line 58, change "stopper" to --stepper--

Signed and Sealed this

Fifth Day of October, 1993

*Attest:*

*Attesting Officer*

BRUCE LEHMAN

*Commissioner of Patents and Trademarks*